US009389550B2

(12) United States Patent
Saito et al.

(10) Patent No.: US 9,389,550 B2
(45) Date of Patent: Jul. 12, 2016

(54) FIXING DEVICE, IMAGE FORMING APPARATUS, AND FIXING METHOD

(71) Applicants: Kazuya Saito, Kanagawa (JP); Takayuki Seki, Kanagawa (JP); Yuji Arai, Kanagawa (JP); Ryuuichi Mimbu, Kanagawa (JP); Yoshiki Yamaguchi, Kanagawa (JP); Shuntaro Tamaki, Kanagawa (JP); Toshihiko Shimokawa, Kanagawa (JP); Hiroshi Yoshinaga, Chiba (JP); Yutaka Ikebuchi, Kanagawa (JP); Shuutaroh Yuasa, Kanagawa (JP)

(72) Inventors: Kazuya Saito, Kanagawa (JP); Takayuki Seki, Kanagawa (JP); Yuji Arai, Kanagawa (JP); Ryuuichi Mimbu, Kanagawa (JP); Yoshiki Yamaguchi, Kanagawa (JP); Shuntaro Tamaki, Kanagawa (JP); Toshihiko Shimokawa, Kanagawa (JP); Hiroshi Yoshinaga, Chiba (JP); Yutaka Ikebuchi, Kanagawa (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/161,662

(22) Filed: Jan. 22, 2014

(65) Prior Publication Data

US 2014/0270832 A1 Sep. 18, 2014

(30) Foreign Application Priority Data

Mar. 15, 2013 (JP) ..... 2013-053777

(51) Int. Cl.
*G03G 15/20* (2006.01)

(52) U.S. Cl.
CPC ..... *G03G 15/2017* (2013.01); *G03G 15/2042* (2013.01); *G03G 15/2039* (2013.01); *G03G 2215/2035* (2013.01)

(58) Field of Classification Search
CPC ..... G03G 15/2042; G03G 15/205
USPC ..... 399/68, 400
See application file for complete search history.

(56) References Cited

U.S. PATENT DOCUMENTS 4,933,727 A * 6/1990 Mizuma et al. ..... 399/298
5,839,013 A * 11/1998 Murasawa et al. ..... 399/15
6,385,410 B1 * 5/2002 Hanyu et al. ..... 399/68

(Continued)

FOREIGN PATENT DOCUMENTS

JP 06083237 A * 3/1994
JP 2004-133268 4/2004

(Continued)

OTHER PUBLICATIONS

U.S. Appl. No. 13/929,920, filed Jun. 28, 2013.

(Continued)

*Primary Examiner* — Minh Phan
*Assistant Examiner* — Leon W Rhodes, Jr.
(74) *Attorney, Agent, or Firm* — Duft Bornsen & Fettig LLP

(57) ABSTRACT

A fixing device includes a fixing rotary body rotatable in a predetermined direction of rotation and a heater disposed opposite and heating the fixing rotary body. An opposed body contacts the fixing rotary body with releasable pressure therebetween to form a fixing nip therebetween through which a recording medium is conveyed. A heat shield is interposed between the heater and the fixing rotary body and movable in a circumferential direction of the fixing rotary body between a home position where the heat shield is disposed opposite the heater indirectly and a shield position where the heat shield is disposed opposite the heater directly to shield the fixing rotary body from the heater. A controller is operatively connected to the heat shield to move the heat shield to the home position when a print job is finished.

20 Claims, 13 Drawing Sheets

(56) References Cited

U.S. PATENT DOCUMENTS

| | | | | |
|---|---|---|---|---|
| 7,058,329 | B2 * | 6/2006 | Takahashi | 399/69 |
| 7,238,924 | B2 * | 7/2007 | Kondo et al. | 219/619 |
| 8,241,826 | B2 * | 8/2012 | Hirano et al. | 430/120.1 |
| 9,046,838 | B2 * | 6/2015 | Arai | G03G 15/20 |
| 2002/0176724 | A1 * | 11/2002 | Fuma et al. | 399/328 |
| 2006/0029411 | A1 | 2/2006 | Ishii et al. | |
| 2007/0292175 | A1 | 12/2007 | Shinshi | |
| 2010/0067929 | A1 | 3/2010 | Seki | |
| 2011/0135325 | A1 * | 6/2011 | Hitaka et al. | 399/21 |
| 2011/0142458 | A1 * | 6/2011 | Sugiyama et al. | 399/8 |
| 2011/0274453 | A1 | 11/2011 | Shimokawa et al. | |
| 2012/0155934 | A1 * | 6/2012 | Takeuchi et al. | 399/329 |
| 2014/0079424 | A1 * | 3/2014 | Ikebuchi | G03G 15/2042 399/69 |

FOREIGN PATENT DOCUMENTS

| | | |
|---|---|---|
| JP | 2004-264785 | 9/2004 |
| JP | 2006-071960 | 3/2006 |
| JP | 2007-334205 | 12/2007 |
| JP | 2008-058833 | 3/2008 |
| JP | 2008-139779 | 6/2008 |
| JP | 2009258203 A * | 11/2009 |
| JP | 2010-032973 | 2/2010 |
| JP | 2010-066583 | 3/2010 |
| JP | 2011-138155 | 7/2011 |

OTHER PUBLICATIONS

U.S. Appl. No. 13/930,582, filed Jun. 28, 2013.
U.S. Appl. No. 14/013,206, filed Aug. 29, 2013.
U.S. Appl. No. 14/014,653, filed Aug. 30, 2013.
U.S. Appl. No. 14/010,823, filed Aug. 27, 2013.
U.S. Appl. No. 14/024,931, filed Sep. 12, 2013.
U.S. Appl. No. 14/015,035, filed Aug. 30, 2013.
U.S. Appl. No. 14/072,027, filed Nov. 5, 2013.

* cited by examiner

FIXING DEVICE, IMAGE FORMING APPARATUS, AND FIXING METHOD

CROSS-REFERENCE TO RELATED APPLICATION

This patent application is based on and claims priority pursuant to 35 U.S.C. §119 to Japanese Patent Application No. 2013-053777, filed on Mar. 15, 2013, in the Japanese Patent Office, the entire disclosure of which is hereby incorporated by reference herein.

BACKGROUND

1. Technical Field

Exemplary aspects of the present invention relate to a fixing device, an image forming apparatus, and a fixing method, and more particularly, to a fixing device for fixing a toner image on a recording medium, an image forming apparatus incorporating the fixing device, and a fixing method for fixing a toner image on a recording medium.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotary body heated by a heater and an opposed body contacting the fixing rotary body to form a fixing nip therebetween through which a recording medium bearing a toner image is conveyed. As the fixing rotary body and the opposed body rotate and convey the recording medium bearing the toner image through the fixing nip, the fixing rotary body heated to a predetermined fixing temperature and the opposed body together heat and melt toner of the toner image, thus fixing the toner image on the recording medium.

Since the recording medium passing through the fixing nip draws heat from the fixing rotary body, a temperature sensor detects the temperature of the fixing rotary body to maintain the fixing rotary body at a desired temperature. Conversely, at each lateral end of the fixing rotary body in an axial direction thereof, the recording medium is not conveyed over the fixing rotary body and therefore does not draw heat from the fixing rotary body. Accordingly, after a plurality of recording media is conveyed through the fixing nip continuously, a non-conveyance span situated at each lateral end of the fixing rotary body may overheat.

To address this circumstance, the fixing device may incorporate a heat shield to shield the non-conveyance span of the fixing rotary body from the heater, thus preventing overheating of the fixing rotary body as disclosed by JP-2008-058833-A and JP-2008-139779-A, for example. The heat shield is movable to shield the fixing rotary body from the heater in a variable span on the fixing rotary body according to the size of the recording medium.

However, if the heater and other interior components are situated inside the fixing rotary body, those components may create a direct heating span on the fixing rotary body where the heater is disposed opposite the fixing rotary body directly and an indirect heating span on the fixing rotary body where the heater is disposed opposite the fixing rotary body indirectly through those interior components. As the heater is turned on, the direct heating span on the fixing rotary body is heated to an increased temperature. Conversely, the indirect heating span on the fixing rotary body is heated to a decreased temperature. Thus, the heater may heat the fixing rotary body unevenly.

Even after the fixing rotary body rotates idly for a while, unevenness of temperature of the fixing rotary body may not be eliminated. For example, when the fixing device is warmed up from a decreased temperature, the opposed body having an increased thermal capacity may draw heat from the fixing rotary body heated by the heater. Accordingly, even after the fixing rotary body rotates idly for an extended period of time, unevenness of temperature of the fixing rotary body may not be eliminated.

Uneven temperature of the fixing rotary body may thermally expand the fixing rotary body locally, causing warping and deformation on the surface of the fixing rotary body which may obstruct formation of the fixing nip between the fixing rotary body and the opposed body. Hence, the fixing rotary body and the opposed body may not apply heat and pressure to the recording medium conveyed through the fixing nip properly.

If the movable heat shield is retained at a halt position where it is halted when the previous print job is finished, the position of the heat shield when the next print job starts may vary depending on the halt position of the heat shield when the previous print job is finished. Accordingly, it may be difficult to adjust the temperature of the fixing rotary body to an even temperature during each print job, causing warping and deformation of the fixing rotary body.

SUMMARY

This specification describes an improved fixing device. In one exemplary embodiment, the fixing device includes a fixing rotary body rotatable in a predetermined direction of rotation and a heater disposed opposite and heating the fixing rotary body. An opposed body contacts the fixing rotary body with releasable pressure therebetween to form a fixing nip therebetween through which a recording medium is conveyed. A heat shield is interposed between the heater and the fixing rotary body and movable in a circumferential direction of the fixing rotary body between a home position where the heat shield is disposed opposite the heater indirectly and a shield position where the heat shield is disposed opposite the heater directly to shield the fixing rotary body from the heater. A controller is operatively connected to the heat shield to move the heat shield to the home position when a print job is finished.

This specification further describes an improved image forming apparatus. In one exemplary embodiment, the image forming apparatus includes the fixing device described above.

This specification further describes an improved fixing method. In one exemplary embodiment, the fixing method includes receiving a print job; determining that a heat shield is at a home position where the heat shield is disposed opposite a heater indirectly; pressing an opposed body against a fixing rotary body; turning on the heater to heat the fixing rotary body; moving the heat shield forward from the home position to a shield position where the heat shield is disposed opposite the heater directly; rotating the fixing rotary body to convey a recording medium through a fixing nip formed between the fixing rotary body and the opposed body; determining that a trailing edge of the recording medium is discharged from the fixing nip; turning off the heater; moving the heat shield backward from the shield position to the home position; determining that the heat shield is at the home position; halting the fixing rotary body; and releasing pressure between the opposed body and the fixing rotary body.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
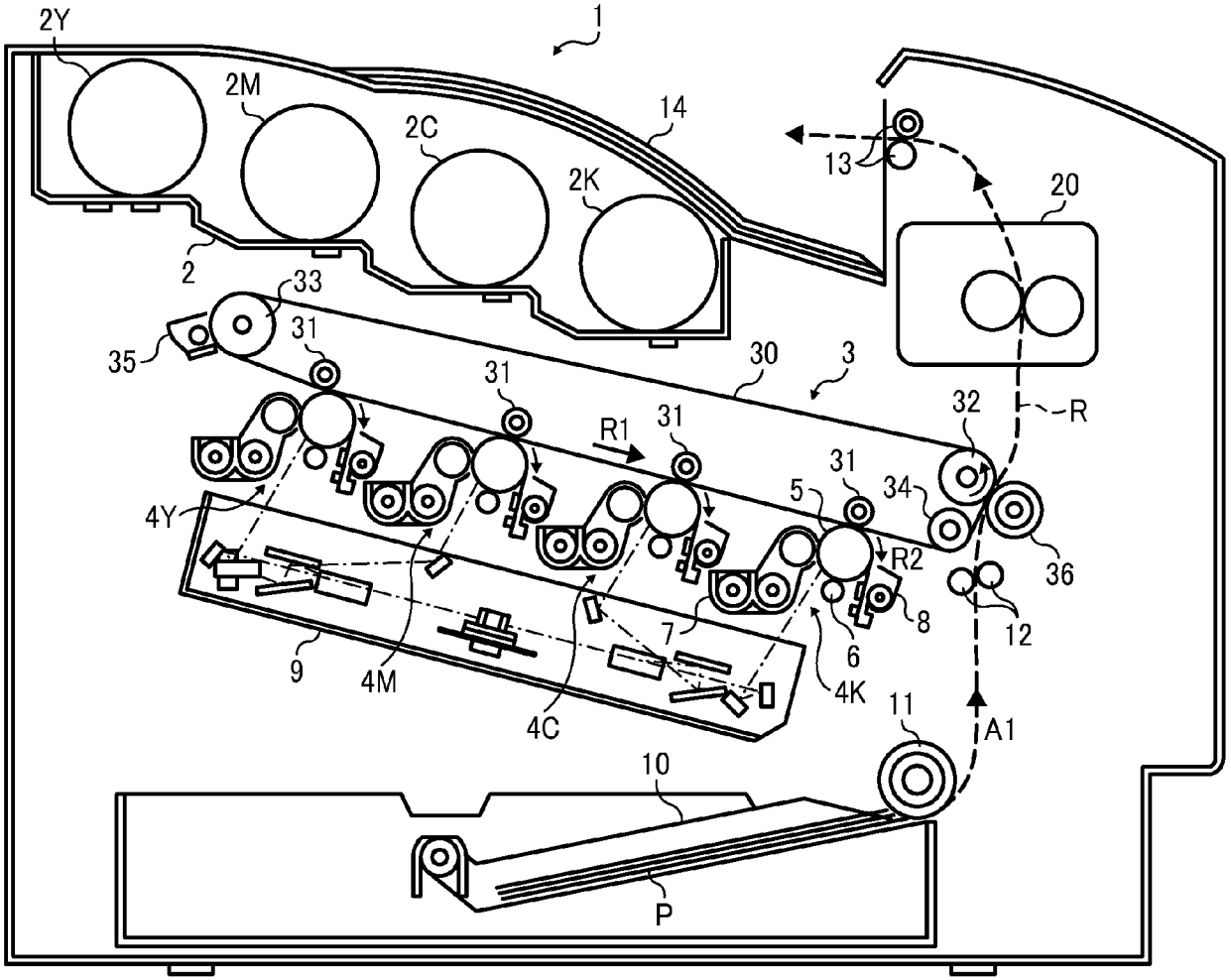
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, overhead projector (OHP) transparencies, and the like. Additionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
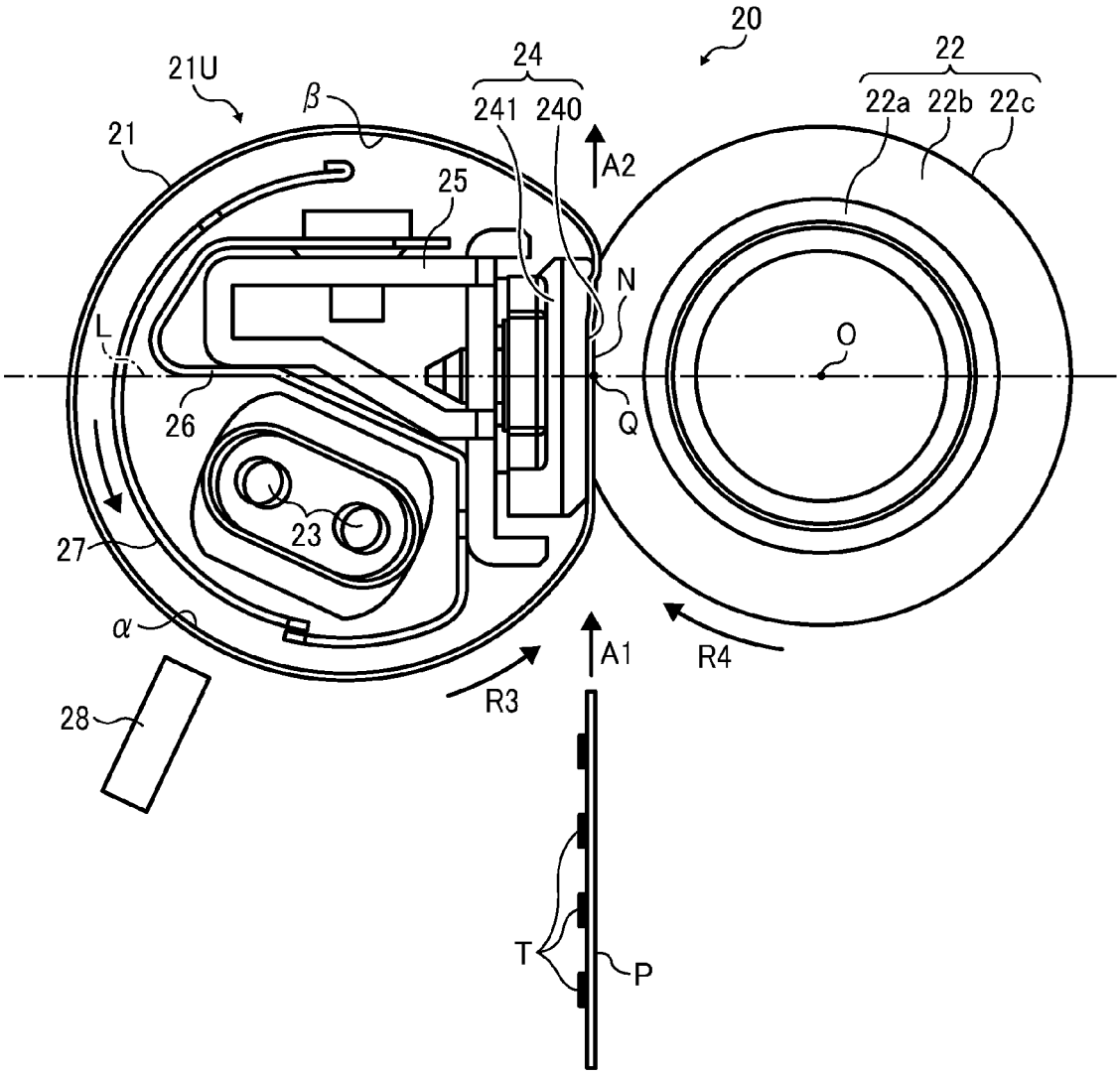
FIG. 2 is a vertical sectional view of a fixing device incorporated in the image forming apparatus shown in FIG. 1 illustrating a heat shield incorporated therein that is situated at a shield position.
Figure 3:
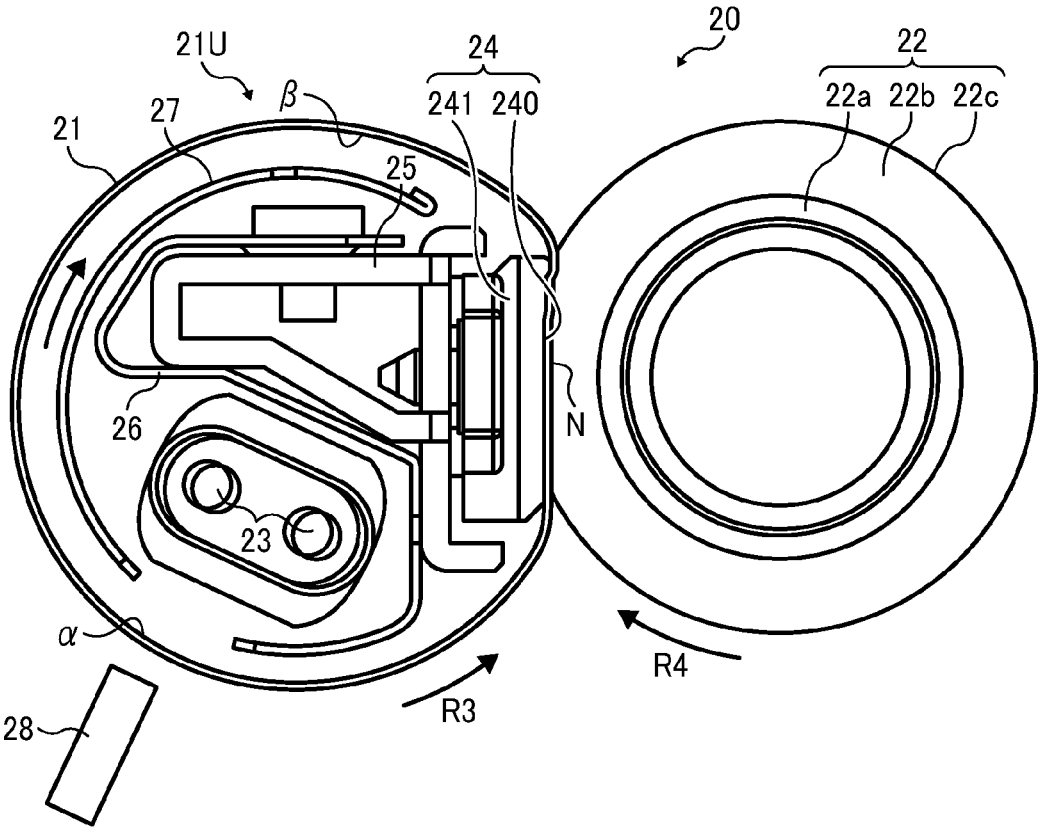
FIG. 3 is a vertical sectional view of the fixing device shown in FIG. 2 illustrating the heat shield situated at a retracted position.
Figure 4:
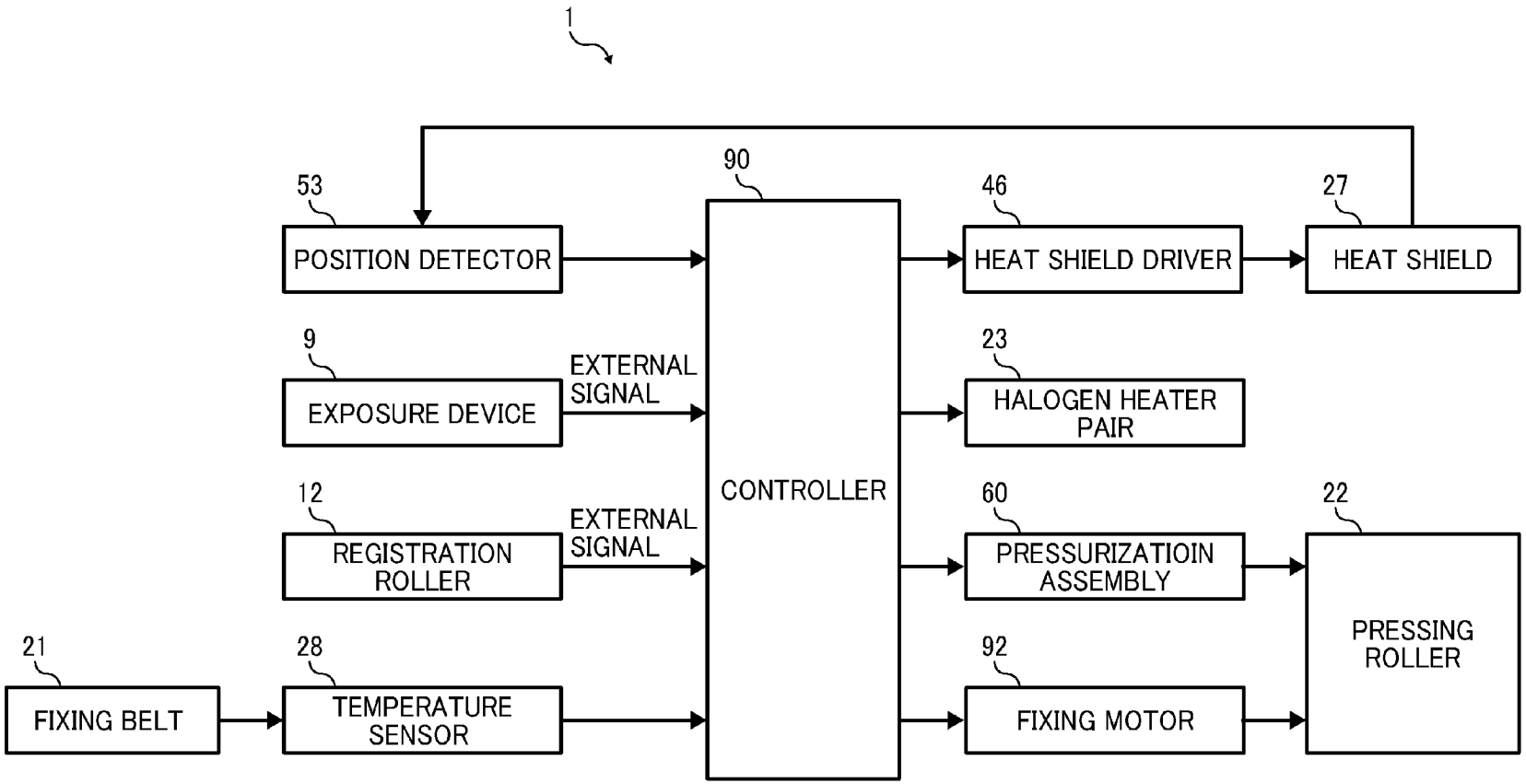
FIG. 4 is a block diagram of the image forming apparatus shown in FIG. 1.

With reference to FIGS. 2 to 4, a description is provided of a construction of the fixing device 20 incorporated in the image forming apparatus 1 described above.

FIG. 2 is a vertical sectional view of the fixing device 20 illustrating a heat shield 27 incorporated therein that is situated at a shield position. FIG. 3 is a vertical sectional view of the fixing device 20 illustrating the heat shield 27 situated at a retracted position. FIG. 4 is a block diagram of the image forming apparatus 1.

As shown in FIG. 2, the fixing device 20 (e.g., a fuser) includes a fixing belt 21 serving as a fixing rotary body or an endless belt formed into a loop and rotatable in a rotation direction R3; a pressing roller 22 serving as an opposed body disposed opposite an outer circumferential surface of the fixing belt 21 to separably contact the fixing belt 21 and rotatable in a rotation direction R4 counter to the rotation direction R3 of the fixing belt 21; a halogen heater pair 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater pair 23 toward the fixing belt 21; the heat shield 27 interposed between the halogen heater pair 23 and the fixing belt 21 to shield the fixing belt 21 from light radiated from the halogen heater pair 23; and a temperature sensor 28 serving as a temperature detector disposed opposite the outer circumferential surface of the fixing belt 21 and detecting the temperature of the fixing belt 21.

The fixing belt 21 and the components disposed inside the loop formed by the fixing belt 21, that is, the halogen heater pair 23, the nip formation assembly 24, the stay 25, the reflector 26, and the heat shield 27, may constitute a belt unit 21U separably coupled with the pressing roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing property of being heated to a predetermined fixing temperature quickly. However, as the pressing roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 100 micrometers. The elastic layer having the thickness not smaller than about 100 micrometers elastically deforms to absorb slight surface asperities of the fixing belt 21, preventing variation in gloss of the toner image T on the recording medium P.

According to this exemplary embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly described below presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. According to this exemplary embodiment, the pressing roller 22 is pressed against the fixing belt 21. Alternatively, the pressing roller 22 may merely contact the fixing belt 21 with no pressure therebetween.

A fixing motor 92 depicted in FIG. 4 that is disposed inside the image forming apparatus 1 serves as a driver that drives and rotates the pressing roller 22. As the fixing motor 92 drives and rotates the pressing roller 22, a driving force of the fixing motor 92 is transmitted from the pressing roller 22 to the fixing belt 21 at the fixing nip N, thus rotating the fixing belt 21 by friction between the pressing roller 22 and the fixing belt 21. Alternatively, the fixing motor 92 may also be connected to the fixing belt 21 to drive and rotate the fixing belt 21.

According to this exemplary embodiment, the pressing roller 22 is a solid roller. Alternatively, the pressing roller 22 may be a hollow roller. In this case, a heater such as a halogen heater may be disposed inside the hollow roller. The elastic layer 22*b* may be made of solid rubber. Alternatively, if no heater is situated inside the pressing roller 22, the elastic layer 22*b* may be made of sponge rubber. The sponge rubber is more preferable than the solid rubber because it has an increased insulation that draws less heat from the fixing belt 21.

A detailed description is now given of a configuration of the halogen heater pair 23.

The halogen heater pair 23 is situated inside the loop formed by the fixing belt 21 and upstream from the fixing nip N in the recording medium conveyance direction A1. For example, the halogen heater pair 23 is situated lower than and upstream from a hypothetical line L passing through a center Q of the fixing nip N in the recording medium conveyance direction A1 and an axis O of the pressing roller 22 in FIG. 2. The power supply situated inside the image forming apparatus 1 supplies power to the halogen heater pair 23 so that the halogen heater pair 23 heats the fixing belt 21. As shown in FIG. 4, a controller 90 (e.g., a processor), that is, a central processing unit (CPU) provided with a random-access memory (RAM) and a read-only memory (ROM), for example, operatively connected to the halogen heater pair 23 and the temperature sensor 28 controls the halogen heater pair 23 based on the temperature of the fixing belt 21 detected by the temperature sensor 28 so as to adjust the temperature of the fixing belt 21 to a desired fixing temperature. Alternatively, the controller 90 may be operatively connected to a temperature sensor disposed opposite the pressing roller 22 to detect the temperature of the pressing roller 22 so that the controller predicts the temperature of the fixing belt 21 based on the temperature of the pressing roller 22 detected by the temperature sensor, thus controlling the halogen heater pair 23.

According to this exemplary embodiment, two halogen heaters constituting the halogen heater pair 23 are situated inside the loop formed by the fixing belt 21. Alternatively, one halogen heater or three or more halogen heaters may be situated inside the loop formed by the fixing belt 21 according to the sizes of the recording media P available in the image forming apparatus 1. Alternatively, instead of the halogen heater pair 23, an induction heater, a resistance heat generator, a carbon heater, or the like may be employed as a heater that heats the fixing belt 21.

A detailed description is now given of a construction of the nip formation assembly 24.

The nip formation assembly 24 includes a base pad 241 and a slide sheet 240 (e.g., a low-friction sheet) covering an outer surface of the base pad 241. For example, the slide sheet 240 covers an opposed face of the base pad 241 disposed opposite the fixing belt 21. A longitudinal direction of the base pad 241 is parallel to an axial direction of the fixing belt 21 or the pressing roller 22. The base pad 241 receives pressure from the pressing roller 22 to define the shape of the fixing nip N. According to this exemplary embodiment, the fixing nip N is planar in cross-section as shown in FIG. 2. Alternatively, the fixing nip N may be concave with respect to the pressing roller 22 or have other shapes. The slide sheet 240 reduces friction between the base pad 241 and the fixing belt 21 sliding thereover as the fixing belt 21 rotates in the rotation direction R3. Alternatively, the base pad 241 may be made of a low friction material. In this case, the slide sheet 240 is not interposed between the base pad 241 and the fixing belt 21.

The base pad 241 is made of a heat resistant material resistant against temperatures of 200 degrees centigrade or higher to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. The base pad 241 is also made of a rigid material having an increased mechanical strength. For example, the base pad 241 is made of resin such as polyether sulfone (PES), polyphenylene sulfide (PPS), liquid crystal polymer (LCP), polyether nitrile (PEN), polyamide imide (PAI), polyether ether ketone (PEEK), or the like. Alternatively, the base pad 241 may be made of metal, ceramic, or the like.

The base pad 241 is mounted on and supported by the stay 25. Accordingly, even if the base pad 241 receives pressure from the pressing roller 22, the base pad 241 is not bent by the pressure and therefore produces a uniform nip width throughout the entire width of the pressing roller 22 in the axial direction thereof. The stay 25 is made of metal having an increased mechanical strength, such as stainless steel and iron, to prevent bending of the nip formation assembly 24.

A detailed description is now given of a construction of the reflector 26.

The reflector 26 is mounted on and supported by the stay 25 and disposed opposite the halogen heater pair 23. The reflector 26 reflects light or heat radiated from the halogen heater pair 23 thereto onto the fixing belt 21, suppressing conduction of heat from the halogen heater pair 23 to the stay 25. Thus, the reflector 26 facilitates efficient heating of the fixing belt 21, saving energy. For example, the reflector 26 is made of aluminum, stainless steel, or the like. If the reflector 26 includes an aluminum base treated with silver-vapor-deposition to decrease radiation and increase reflectance of light, the reflector 26 facilitates heating of the fixing belt 21.

A detailed description is now given of a configuration of the heat shield 27.

The heat shield 27 is a metal plate, having a thickness in a range of from about 0.1 mm to about 1.0 mm, curved in a circumferential direction of the fixing belt 21 along the inner circumferential surface thereof. The heat shield 27 is interposed between the halogen heater pair 23 and the fixing belt 21 and movable in the circumferential direction of the fixing belt 21. As shown in FIG. 3, a circumference of the fixing belt 21 is divided into two sections: a circumferential, direct heating span α where the halogen heater pair 23 is disposed opposite and heats the fixing belt 21 directly and a circumferential, indirect heating span β where the halogen heater pair 23 is disposed opposite the fixing belt 21 indirectly via the components other than the heat shield 27 (e.g., the reflector 26, the stay 25, the nip formation assembly 24, and the like) that are mounted on a pair of side plates of the fixing device 20, thus heating the fixing belt 21 indirectly.

The heat shield 27 moves to the shield position shown in FIG. 2 where the heat shield 27 is disposed opposite the halogen heater pair 23 directly in the direct heating span α to shield the fixing belt 21 from the halogen heater pair 23. The shield position may be located at one or more positions within the direct heating span a. Conversely, the heat shield 27 moves to the retracted position shown in FIG. 3 where the heat shield 27 retracts from the direct heating span α to the indirect heating span β and therefore is disposed opposite the halogen heater pair 23 indirectly. That is, the heat shield 27 is entirely behind the reflector 26 and the stay 25 and therefore disposed opposite the halogen heater pair 23 via the reflector 26 and the stay 25. Thus, the heat shield 27 does not shield the fixing belt 21 from the halogen heater pair 23. As the heat shield 27 moves in the circumferential direction of the fixing belt 21, the heat shield 27 changes the area of the direct heating span α on the fixing belt 21, adjusting an amount of heat radiated from the halogen heater pair 23 to the fixing belt 21. The heat shield 27 is made of a heat resistant material, for example, metal such as aluminum, iron, and stainless steel or ceramic.

Figure 5:
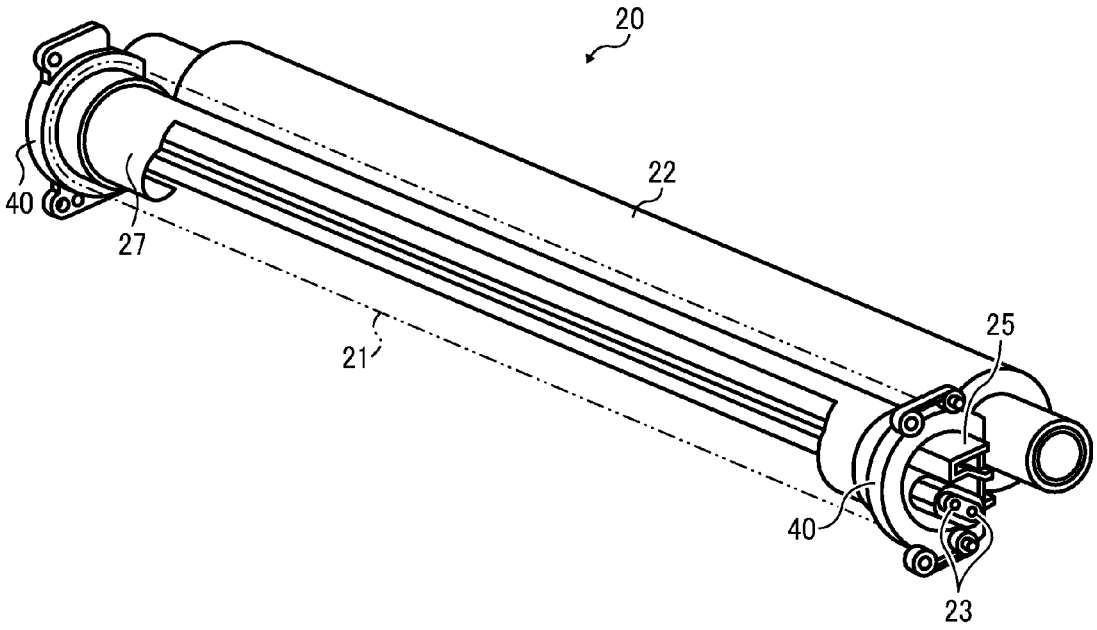
FIG. 5 is a partial perspective view of the fixing device shown in FIG. 3.

With reference to FIG. 5, a description is provided of a configuration of flanges 40 incorporated in the fixing device 20.

FIG. 5 is a partial perspective view of the fixing device 20. As shown in FIG. 5, the flanges 40 serving as a belt holder are inserted into both lateral ends of the fixing belt 21 in the axial direction thereof, respectively, to rotatably support the fixing belt 21. Both lateral ends of the flanges 40, the halogen heater pair 23, and the stay 25 in the axial direction of the fixing belt 21 are mounted on and supported by the pair of side plates of the fixing device 20, respectively.

Figure 6:
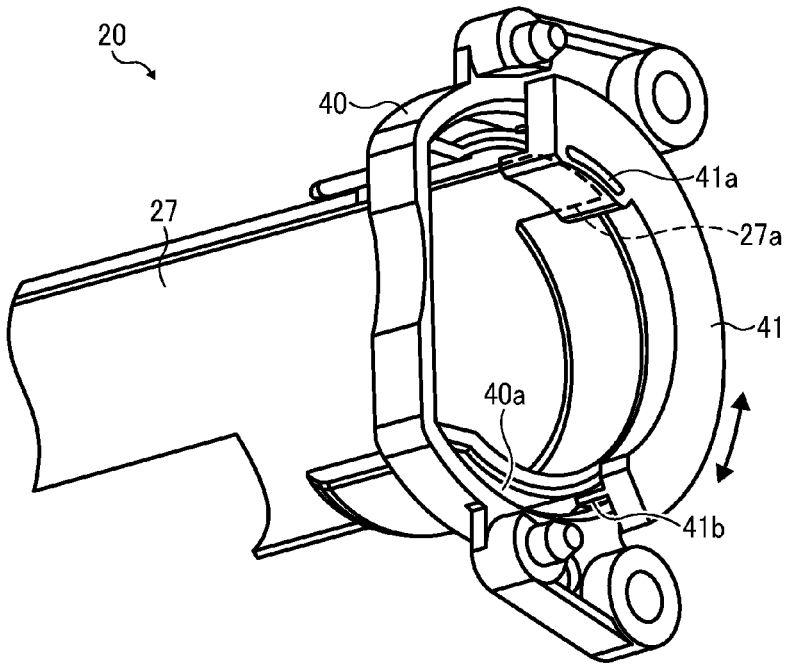
FIG. 6 is a partial perspective view of the fixing device shown in FIG. 2 illustrating one lateral end of the heat shield in an axial direction thereof.

With reference to FIG. 6, a description is provided of a construction of a support mechanism that supports the heat shield 27.

FIG. 6 is a partial perspective view of the fixing device 20 illustrating one lateral end of the heat shield 27 in the axial direction of the fixing belt 21. As shown in FIG. 6, the heat shield 27 is supported by an arcuate slider 41 rotatably or slidably attached to the flange 40. For example, a projection 27*a* disposed at each lateral end of the heat shield 27 in the axial direction of the fixing belt 21 is inserted into a hole 41*a* produced in the slider 41. Thus, the heat shield 27 is attached to the slider 41. The slider 41 includes a tab 41*b* projecting inboard in the axial direction of the fixing belt 21 toward the heat shield 27. As the tab 41*b* of the slider 41 is inserted into an arcuate groove 40*a* produced in the flange 40, the slider 41 is slidably movable in the groove 40*a*. Accordingly, the heat shield 27, together with the slider 41, is rotatable or movable in a circumferential direction of the flange 40. The flange and the slider 41 are made of resin.

Although FIG. 6 illustrates the support mechanism that supports the heat shield 27 at one lateral end thereof in the axial direction of the fixing belt 21, another lateral end of the heat shield 27 in the axial direction of the fixing belt 21 is also supported by the support mechanism shown in FIG. 6. Thus, another lateral end of the heat shield 27 is also rotatably or movably supported by the slider 41 slidable in the groove 40*a* of the flange 40.

Figure 7:
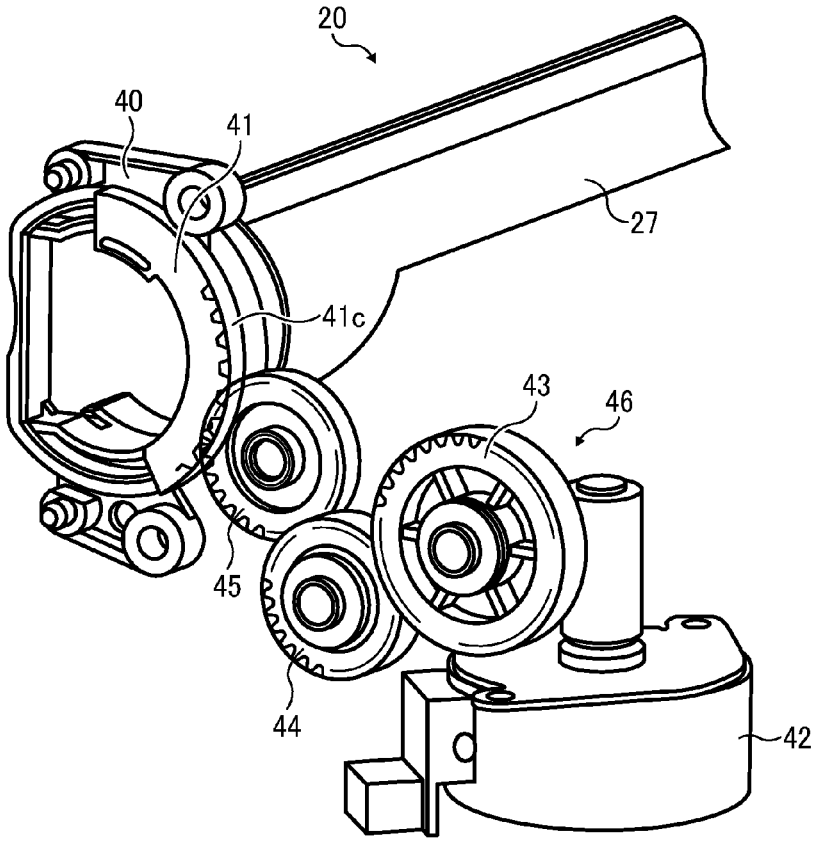
FIG. 7 is a partial perspective view of the fixing device shown in FIG. 2 illustrating a heat shield driver incorporated therein.

With reference to FIG. 7, a description is provided of a construction of a heat shield driver 46 that drives and rotates the heat shield 27.

FIG. 7 is a partial perspective view of the fixing device 20 illustrating the heat shield driver 46. As shown in FIG. 7, the heat shield driver 46 includes a motor 42 serving as a driving source and a plurality of gears 43, 44, and 45 constituting a gear train. The gear 43 serving as one end of the gear train is connected to the motor 42. The gear 45 serving as another end of the gear train is connected to a gear 41*c* produced on the slider 41 along a circumferential direction thereof. Accordingly, as the motor 42 is driven, a driving force is transmitted from the motor 42 to the gear 41*c* of the slider 41 through the gear train, that is, the gears 43 to 45, thus rotating the heat shield 27 supported by the slider 41 forward in a first rotation direction from the indirect heating span β to the direct heating span α and backward in a second rotation direction from the direct heating span α to the indirect heating span β. For example, the motor 42 is a stepping motor. In this case, the position of the heat shield 27 is adjusted by changing the number of driving pulses. Instead of the stepping motor, the motor 42 may be a direct current (DC) motor or the like.

Figure 8:
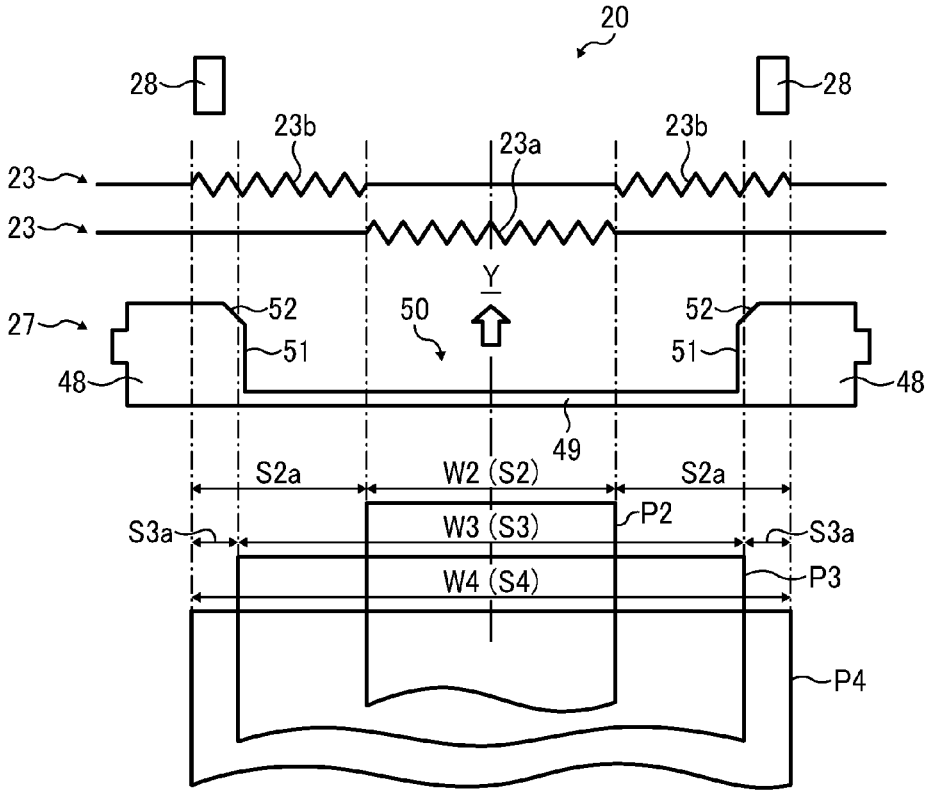
FIG. 8 is a schematic diagram of the fixing device shown in FIG. 3 illustrating a halogen heater pair incorporated therein, the heat shield, and recording media of various sizes.

With reference to FIG. 8, a description is provided of a relation between the shape of the heat shield 27, heat generators of the halogen heater pair 23, and the sizes of recording media.

FIG. 8 is a schematic diagram of the fixing device 20 illustrating the halogen heater pair 23, the heat shield 27, and recording media of various sizes.

First, a detailed description is given of the shape of the heat shield 27.

As shown in FIG. 8, the heat shield 27 includes a pair of shield portions 48, constituting both lateral ends of the heat shield 27 in an axial direction, that is, the longitudinal direction, thereof; a bridge 49 bridging the shield portions 48 in the axial direction of the heat shield 27; and a recess 50 defined by the shield portions 48 and the bridge 49, and in turn itself defining an inboard edge of each shield portion 48. The shield portions 48 are disposed opposite both lateral ends of the halogen heater pair 23 in the axial direction of the fixing belt 21, respectively, to shield both lateral ends of the fixing belt 21 in the axial direction thereof from the halogen heater pair 23. The recess 50 between the pair of shield portions 48 in the axial direction of the heat shield 27 does not shield the fixing belt 21 from the halogen heater pair 23 and therefore allows light radiated from the halogen heater pair 23 to irradiate the fixing belt 21.

The inboard edge of each shield portion 48 includes a circumferentially straight edge 51 extending parallel to the circumferential direction of the heat shield 27 in which the heat shield 27 pivots and a sloped edge 52 angled relative to the circumferentially straight edge 51. As shown in FIG. 8, the sloped edge 52 is contiguous to the circumferentially straight edge 51 substantially in a shield direction Y in which the heat shield 27 moves from the retracted position shown in FIG. 3 to the shield position shown in FIG. 2. The sloped edge 52 is angled outboard from the circumferentially straight edge 51 substantially in the shield direction Y such that an interval between the sloped edge 52 and another sloped edge 52 increases. Accordingly, the recess 50 has a uniform, decreased width defined by the circumferentially straight edges 51 in the axial direction of the heat shield 27 and an increased width defined by the sloped edges 52 in the axial direction of the heat shield 27 that increases gradually in the shield direction Y.

Next, a detailed description is given of a relation between the heat generators of the halogen heater pair 23 and the sizes of the recording media.

As shown in FIG. 8, the halogen heater pair 23 has a plurality of heat generators having different lengths in the axial direction of the fixing belt 21 and being situated at different positions in the axial direction of the fixing belt 21 to heat different axial spans on the fixing belt 21 according to the size of the recording medium P. For example, the halogen heater pair 23 is constructed of the lower halogen heater 23 having a center heat generator 23*a* disposed opposite a center of the fixing belt 21 in the axial direction thereof and the upper halogen heater 23 having lateral end heat generators 23*b* disposed opposite both lateral ends of the fixing belt 21 in the axial direction thereof, respectively. The center heat generator 23*a* spans a conveyance span S2 corresponding to a width W2 of a medium recording medium P2 in the axial direction of the fixing belt 21. Conversely, the lateral end heat generators 23*b*, together with the center heat generator 23*a*, span a conveyance span S3 corresponding to a width W3 of a large recording medium P3 greater than the width W2 of the medium recording medium P2 and a conveyance span S4 corresponding to a width W4 of an extra-large recording medium P4 greater than the width W3 of the large recording medium P3.

A detailed description is now given of a relation between the shape of the heat shield 27 and the sizes of the recording media P2, P3, and P4.

Each circumferentially straight edge 51 is situated inboard from and in proximity to an edge of the conveyance span S3 corresponding to the width W3 of the large recording medium P3 in the axial direction of the fixing belt 21. Each sloped edge 52 overlaps the edge of the conveyance span S3.

For example, the medium recording medium P2 is a letter size recording medium having a width W2 of 215.9 mm or an A4 size recording medium having a width W2 of 210 mm. The large recording medium P3 is a double letter size recording medium having a width W3 of 279.4 mm or an A3 size recording medium having a width W3 of 297 mm. The extra-large recording medium P4 is an A3 extension size recording medium having a width W4 of 329 mm. However, the medium recording medium P2, the large recording medium P3, and the extra-large recording medium P4 may include recording media of other sizes. Additionally, the medium, large, and extra-large sizes mentioned herein are relative terms. Hence, instead of the medium, large, and extra-large sizes, small, medium, and large sizes may be used.

Figure 9:
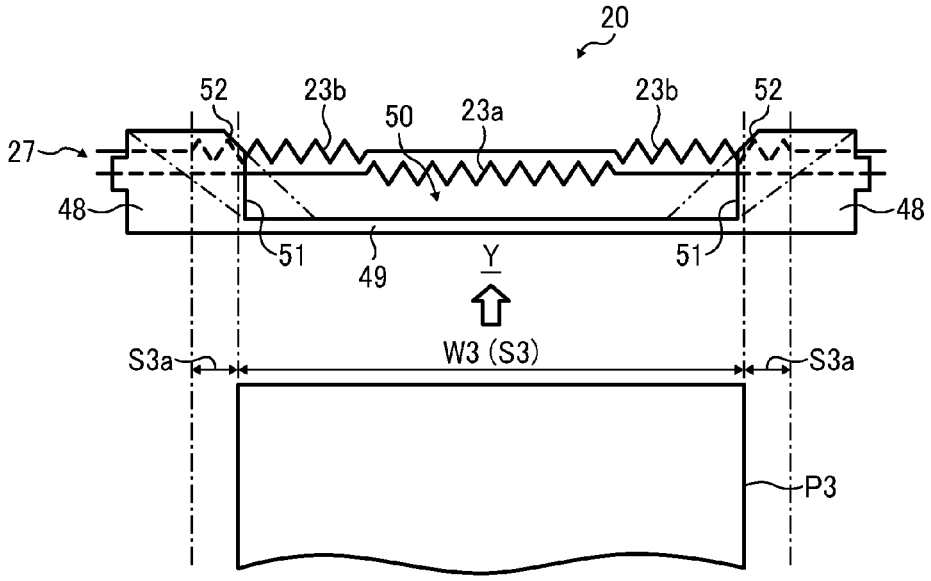
FIG. 9 is a partial schematic diagram of the fixing device shown in FIG. 2 illustrating the heat shield at the shield position.

With reference to FIGS. 8 and 9, a description is provided of control of the halogen heater pair 23 and the heat shield 27 according to the sizes of recording media.

FIG. 9 is a partial schematic diagram of the fixing device 20. As the medium recording medium P2 is conveyed over the fixing belt 21 depicted in FIG. 2, the controller 90 depicted in FIG. 4 turns on the center heat generator 23*a* to heat the conveyance span S2 of the fixing belt 21 corresponding to the width W2 of the medium recording medium P2. As the extra-large recording medium P4 is conveyed over the fixing belt 21, the controller 90 turns on the lateral end heat generators 23*b* as well as the center heat generator 28*a* to heat the conveyance span S4 of the fixing belt 21 corresponding to the width W4 of the extra-large recording medium P4.

However, the halogen heater pair 23 is configured to heat the conveyance span S2 corresponding to the width W2 of the medium recording medium P2 and the conveyance span S4 corresponding to the width W4 of the extra-large recording medium P4. Accordingly, if the center heat generator 23*a* is turned on as the large recording medium P3 is conveyed over the fixing belt 21, the center heat generator 23*a* does not heat each outboard span S2 a outboard from the conveyance span S2 in the axial direction of the fixing belt 21. Consequently, the large recording medium P3 is not heated throughout the entire width W3 thereof. Conversely, if the lateral end heat generators 23*b* and the center heat generator 23*a* are turned on, the lateral end heat generators 23*b* may heat both outboard spans S3 a outboard from the conveyance span S3 in the axial direction of the fixing belt 21 corresponding to the width W3 of the large recording medium P3. If the large recording medium P3 is conveyed over the fixing belt 21 while the lateral end heat generators 23*b* and the center heat generator 23*a* are turned on, the lateral end heat generators 23*b* may heat both outboard spans S3*a* outboard from the conveyance span S3 in the axial direction of the fixing belt 21 corresponding to the width W3 of the large recording medium P3, resulting in overheating of the fixing belt 21 in the outboard spans S3*a*.

To address this circumstance, as the large recording medium P3 is conveyed over the fixing belt 21, the heat shield 27 moves to the shield position as shown in FIG. 9. At the shield position shown in FIG. 9, the shield portions 48 of the heat shield 27 shield the fixing belt 21 in a span in proximity to both side edges of the large recording medium P3 and the outboard spans S3*a*, thus suppressing overheating of the fixing belt 21 in the outboard spans S3 a where the large recording medium P3 is not conveyed. Thus, the fixing device 20 performs a fixing job precisely by moving the heat shield 27 to the shield position shown in FIG. 2 at a proper time without decreasing the rotation speed of the fixing belt 21 and the pressing roller 22 to convey the large recording medium P3.

When the fixing job is finished or the temperature of the outboard spans S3*a* of the fixing belt 21 where the large recording medium P3 is not conveyed decreases to a predetermined threshold and therefore the heat shield 27 is no longer requested to shield the fixing belt 21, the controller 90 moves the heat shield 27 to the retracted position shown in FIG. 3 where the heat shield 27 is disposed opposite the indirect heating span β on the fixing belt 21.

Since each shield portion 48 includes the sloped edge 52 as shown in FIG. 8, as the rotation angle of the heat shield 27 changes, the shield portions 48 shield the fixing belt 21 from the lateral end heat generators 23*b* in a variable area. For example, if the number of recording media conveyed through the fixing nip N and a conveyance time for which the recording media are conveyed through the fixing nip N increase, the fixing belt 21 is subject to overheating in a non-conveyance span (e.g., the outboard spans S2*a* and S3*a*) thereof. To address this circumstance, when the number of recording media conveyed through the fixing nip N reaches a predetermined number or when the conveyance time reaches a predetermined conveyance time, the controller 90 moves the heat shield 27 in the shield direction Y to the shield position shown in FIG. 2 where the shield portions 48 are disposed opposite the lateral end heat generators 23*b*, respectively, suppressing overheating of the fixing belt 21 precisely.

The temperature sensor 28 for detecting the temperature of the fixing belt 21 is disposed opposite an axial span on the fixing belt 21 where the fixing belt 21 is subject to overheating. According to this exemplary embodiment, as shown in FIG. 8, the temperature sensor 28 is disposed opposite each outboard span S3*a* outboard from the conveyance span S3 corresponding to the width W3 of the large recording medium P3 because the fixing belt 21 is subject to overheating in the outboard span S3*a*. Since the fixing belt 21 is subject to overheating by light radiated from the lateral end heat generators 23*b*, the temperature sensors 28 are disposed opposite the lateral end heat generators 23*b*, respectively. Although FIG. 8 illustrates the two temperature sensors 28 disposed opposite the conveyance span S4 corresponding to the width W4 of the extra-large recording medium P4, one of the two temperature sensors 28 may be eliminated. Alternatively, the temperature sensor 28 may be located at other positions, for example, the temperature sensor 28 may be disposed opposite a center of the fixing belt 21 in the axial direction thereof. The number of the temperature sensors 28 may be changed arbitrarily. For example, three or more temperature sensors 28 may be aligned in the axial direction of the fixing belt 21.

Figure 10:
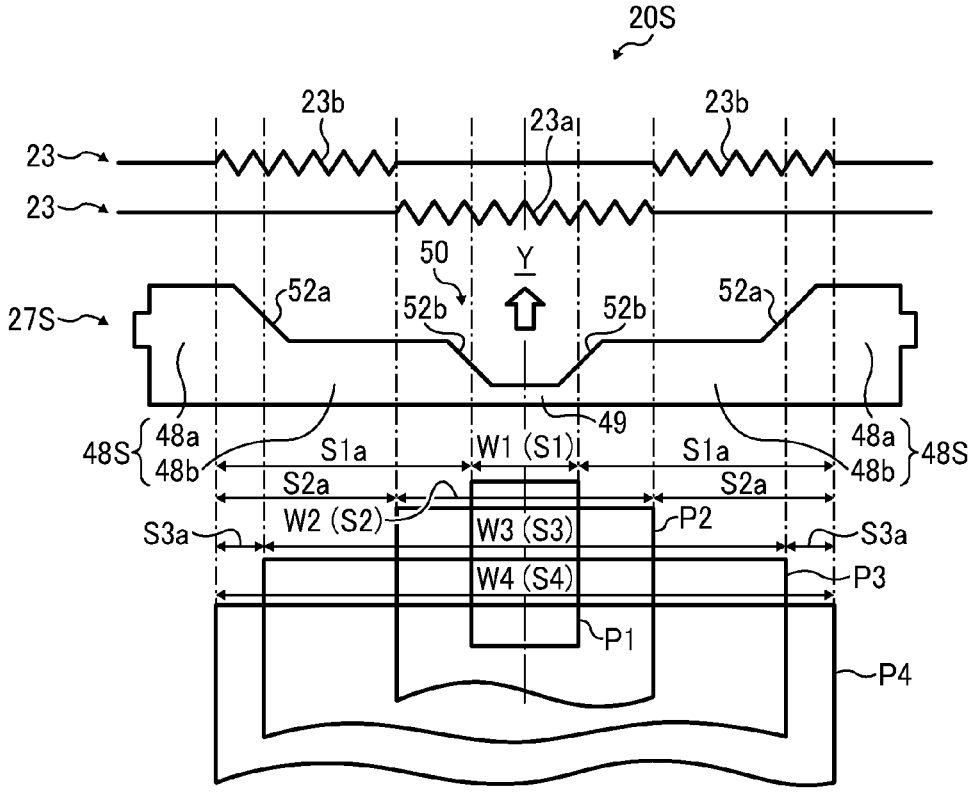
FIG. 10 is a schematic diagram of a fixing device according to another exemplary embodiment.
Figure 11:
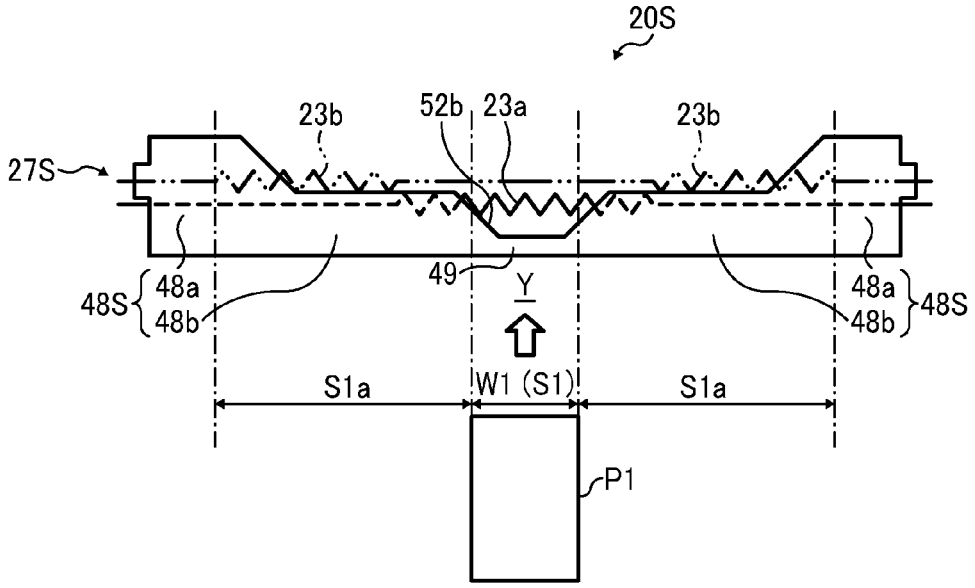
FIG. 11 is a partial schematic diagram of the fixing device shown in FIG. 10 illustrating a heat shield incorporated therein that is situated at the shield position.

With reference to FIGS. 10 and 11, a description is provided of a configuration of a fixing device 20S incorporating a heat shield 27S according to another exemplary embodiment.

FIG. 10 is a schematic diagram of the fixing device 20S. FIG. 11 is a partial schematic diagram of the fixing device 20S. As shown in FIG. 10, the heat shield 27S includes a pair of shield portions 48S disposed at both lateral ends of the heat shield 27S in an axial direction thereof, respectively. Each of the shield portions 48S has two steps. For example, each shield portion 48S includes an outboard, small shield section 48*a* having a decreased length in a longitudinal direction of the heat shield 27S parallel to the axial direction thereof and an inboard, great shield section 48*b* having an increased length in the longitudinal direction of the heat shield 27S. The bridge 49 bridges the great shield section 48*b* of one shield portion 48S serving as a primary shield portion situated at one lateral end of the heat shield 27S and the great shield section 48*b* of another shield portion 48S serving as a secondary shield portion situated at another lateral end of the heat shield 27S in the axial direction thereof. The small shield section 48*a* is contiguous to the great shield section 48*b* substantially in the shield direction Y.

A sloped edge 52*a*, that is, an inboard edge of the small shield section 48*a* in the axial direction of the heat shield 27S, is disposed opposite another sloped edge 52*a*, that is, an inboard edge of another small shield section 48*a* in the axial direction of the heat shield 27S. Similarly, a sloped edge 52*b*, that is, an inboard edge of the great shield section 48*b* in the axial direction of the heat shield 27S, is disposed opposite another sloped edge 52*b*, that is, an inboard edge of another great shield section 48*b* in the axial direction of the heat shield 27S. The two sloped edges 52*b* of the great shield sections 48*b* are angled relative to the bridge 49 such that an interval between the two sloped edges 52*b* in the axial direction of the heat shield 27S increases gradually in the shield direction Y. Similarly, the two sloped edges 52*a* of the small shield sections 48*a* are angled relative to the bridge 49 such that an interval between the two sloped edges 52*a* in the axial direction of the heat shield 27S increases gradually in the shield direction Y. Unlike the heat shield 27 depicted in FIG. 8, the heat shield 27S does not incorporate the circumferentially straight edges 51.

At least four sizes of recording media P, including a small recording medium P1, a medium recording medium P2, a large recording medium P3, and an extra-large recording medium P4, are available in the fixing device 20S. For example, the small recording medium P1 includes a postcard having a width of 100 mm. The medium recording medium P2 includes an A4 size recording medium having a width of 210 mm. The large recording medium P3 includes an A3 size recording medium having a width of 297 mm. The extra-large recording medium P4 includes an A3 extension size recording medium having a width of 329 mm. However, the small recording medium P1, the medium recording medium P2, the large recording medium P3, and the extra-large recording medium P4 may include recording media of other sizes.

A width W1 of the small recording medium P1 is smaller than the length of the center heat generator 23*a* in a longitudinal direction of the halogen heater pair 23 parallel to the axial direction of the heat shield 27S. The sloped edge 52*b* of the great shield section 48*b* overlaps a side edge of the small recording medium P1. The sloped edge 52*a* of the small shield section 48*a* overlaps a side edge of the large recording medium P3. It is to be noted that a description of the relation between the position of recording media other than the small recording medium P1, that is, the medium recording medium P2, the large recording medium P3, and the extra-large recording medium P4, and the position of the center heat generator 23*a* and the lateral end heat generators 23*b* of the fixing device 20S is omitted because it is similar to that of the fixing device 20 described above.

As the small recording medium P1 is conveyed through the fixing nip N, the center heat generator 23*a* is turned on. However, since the center heat generator 23*a* heats the conveyance span S2 on the fixing belt 21 corresponding to the width W2 of the medium recording medium P2 that is greater than the width W1 of the small recording medium P1, the controller 90 moves the heat shield 27S to the shield position shown in FIG. 11. At the shield position shown in FIG. 11, each great shield section 48*b* of the heat shield 27S shields the fixing belt 21 from the center heat generator 23*a* in an outboard span S1*a* outboard from a conveyance span S1 corresponding to the width W1 of the small recording medium P1 in the axial direction of the fixing belt 21. Accordingly, the fixing belt 21 does not overheat in each outboard span S1*a* where the small recording medium P1 is not conveyed over the fixing belt 21.

As the medium recording medium P2, the large recording medium P3, and the extra-large recording medium P4 are conveyed through the fixing nip N, the controller 90 performs a control for controlling the halogen heater pair 23 and the heat shield 27S that is similar to the control for controlling the halogen heater pair 23 and the heat shield 27 described above. In this case, each small shield section 48*a* of the heat shield 27S shields the fixing belt 21 from the halogen heater pair 23 as each shield portion 48 of the fixing device 20 does.

Like the shield portion 48 of the fixing device 20 that has the sloped edge 52, the small shield section 48*a* and the great shield section 48*b* have the sloped edges 52*a* and 52*b*, respectively. Accordingly, by changing the rotation angled position of the heat shield 27S, the controller 90 changes the span on the fixing belt 21 shielded from the center heat generator 23*a* and the lateral end heat generators 23*b* of the halogen heater pair 23 by the small shield section 48*a* and the great shield section 48*b* of each shield portion 48S.

Figure 12:
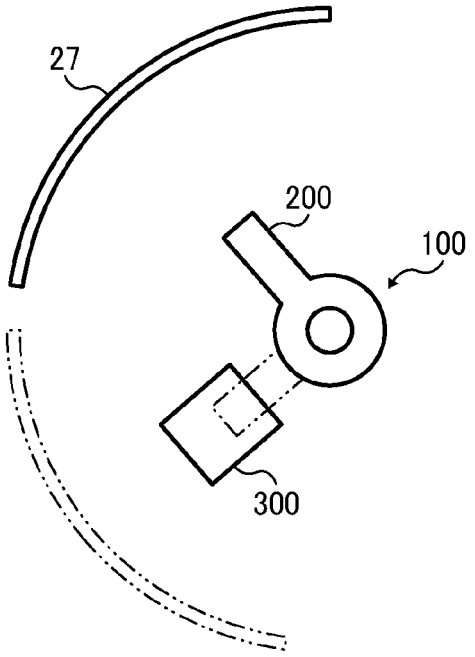
FIG. 12 is a vertical sectional view of the heat shield shown in FIG. 8 and a comparative position detector linked with the heat shield.

In order to place the heat shields 27 and 27S properly according to the size of the recording medium P as described above, the fixing devices 20 and 20S may include a comparative position detector 100 that detects the rotation angled position of the heat shields 27 and 27S as shown in FIG. 12. FIG. 12 is a vertical sectional view of the heat shield 27 and the comparative position detector 100. It is to be noted that the heat shield 27 is replaceable with the heat shield 27S depicted in FIG. 10. As shown in FIG. 12, the comparative position detector 100 includes a feeler 200 serving as a detected member pivotable in accordance with movement of the heat shield 27 and a sensor 300 that detects the feeler 200. As the feeler 200 pivots in accordance with movement of the heat shield 27, the feeler 200 enters a gap between a light emitter and a light receiver of the sensor 300, shielding the light receiver from light emitted from the light emitter. That is, as the sensor 300 detects the feeler 200 reaching a shield position indicated by the dotted line from a home position indicated by the solid line, the controller 90 depicted in FIG. 4 operatively connected to the comparative position detector 100 determines that the heat shield 27 reaches the shield position indicated by the dotted line from the home position indicated by the solid line.

Incidentally, if the image forming apparatus 1 depicted in FIG. 1 accidentally interrupts its operation as the recording medium P is jammed inside the image forming apparatus 1 or other faults occur or as the fixing device 20 is detached from the image forming apparatus 1, the heat shield 27 may not have returned to the home position. In this case, it is necessary to return the heat shield 27 to the home position as the image forming apparatus 1 resumes its operation.

Figure 13:
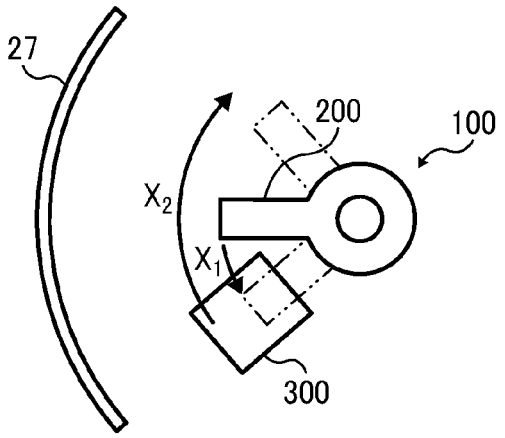
FIG. 13 is a vertical sectional view of the heat shield and the comparative position detector shown in FIG. 12 illustrating a feeler incorporated therein that is situated between a home position and a shield position.

FIG. 13 is a vertical sectional view of the heat shield 27 and the comparative position detector 100 illustrating the feeler 200 situated between the home position and the shield position. For example, if the feeler 200 halts between the home position and the shield position where the feeler 200 overlaps the sensor 300, the controller 90 pivots the heat shield 27 forward in a first pivot direction X1 corresponding to the rotation direction R3 of the fixing belt 21 so as to determine the position of the heat shield 27. As the sensor 300 detects the feeler 200, the controller 90 controls pulses of the motor 42 of the heat shield driver 46 operatively connected to the controller 90 as shown in FIG. 4 to pivot the heat shield 27 backward in a second pivot direction X2, thus moving the heat shield 27 to the home position. However, once the heat shield 27 moves in the forward, first pivot direction X1, it takes time to return the heat shield 27 to the home position. Accordingly, as the image forming apparatus 1 is turned on or powered on, it may take longer to warm up the image forming apparatus 1 from an ambient temperature to a predetermined reload temperature at which the toner image T is formed on the recording medium P.

To address this circumstance, the fixing devices 20 and 20S include a position detector 53 that detects the rotation angled position of the heat shield 27 as shown in FIGS. 14A to 14D. It is to be noted that the heat shield 27 shown in FIGS. 14A to 14D is replaceable with the heat shield 27S depicted in FIG. 10.

With reference to FIGS. 14A to 14D, a description is provided of a configuration of the position detector 53 incorporated in the fixing device 20.

Figure 14A:
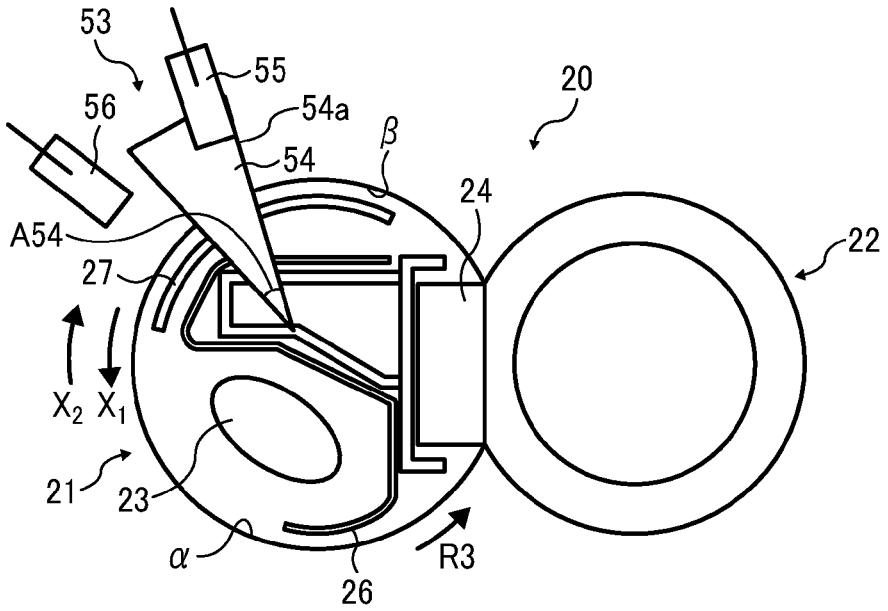
FIG. 14A is a vertical sectional view of the fixing device shown in FIG. 2 illustrating a position detector situated at the home position.
Figure 14B:
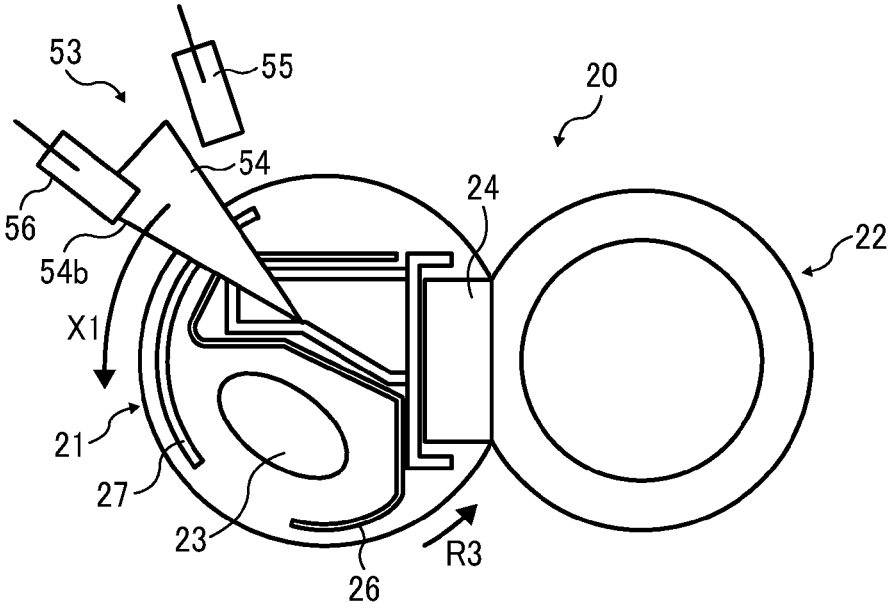
FIG. 14B is a vertical sectional view of the fixing device shown in FIG. 14A illustrating the position detector situated at a reference position.
Figure 14C:
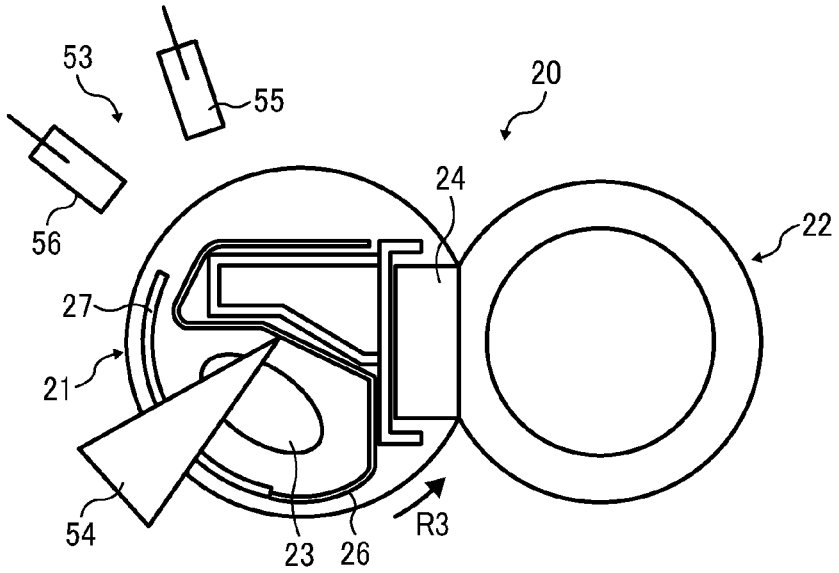
FIG. 14C is a vertical sectional view of the fixing device shown in FIG. 14A illustrating the position detector situated at the shield position.
Figure 14D:
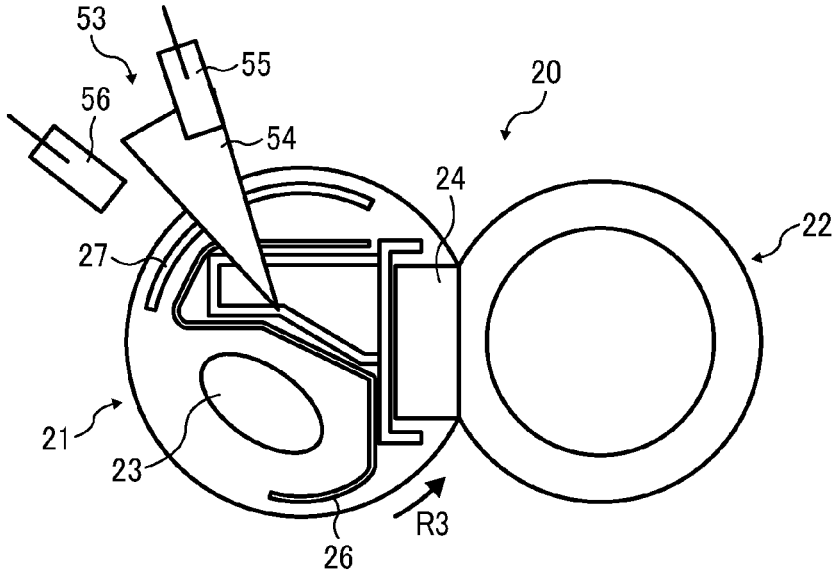
FIG. 14D is a vertical sectional view of the fixing device shown in FIG. 14A illustrating the position detector returned to the home position.

FIG. 14A is a vertical sectional view of the fixing device 20 illustrating the position detector 53 situated at a home position. FIG. 14B is a vertical sectional view of the fixing device 20 illustrating the position detector 53 situated at a reference position. FIG. 14C is a vertical sectional view of the fixing device 20 illustrating the position detector 53 situated at the shield position. FIG. 14D is a vertical sectional view of the fixing device 20 illustrating the position detector 53 situated at the home position.

For example, the position detector 53 includes a single feeler 54 serving as a detected member and two sensors that detect the feeler 54, that is, a home position sensor 55 and an angle sensor 56. The feeler 54 is substantially formed in a fan or a triangle pivotable forward in the first pivot direction X1 corresponding to the rotation direction R3 of the fixing belt 21 and backward in the second pivot direction X2 in accordance with movement of the heat shield 27 through a linkage. The home position sensor 55 and the angle sensor 56 are mounted on a frame of the fixing device 20 such that the angle sensor 56 is isolated from the home position sensor 55 in the first pivot direction X1 of the feeler 54. Each of the home position sensor 55 and the angle sensor 56 is a photo interrupter constructed of a light emitter and a light receiver, for example. As the feeler 54 enters a gap between the light emitter and the light receiver of each of the home position sensor 55 and the angle sensor 56 to shield the light receiver from light emitted from the light emitter, each of the home position sensor 55 and the angle sensor 56 outputs a high signal to the controller 90 depicted in FIG. 4 that is operatively connected to the home position sensor 55 and the angle sensor 56 of the position detector 53. Conversely, as the feeler 54 exits from the gap between the light emitter and the light receiver of each of the home position sensor 55 and the angle sensor 56 to allow the light emitted from the light emitter to reach the light receiver, each of the home position sensor 55 and the angle sensor 56 outputs a low signal to the controller 90.

The home position sensor 55 situated upstream from the angle sensor 56 in the rotation direction R3 of the fixing belt 21 serves as a home position detector that detects the home position of the heat shield 27. The angle sensor 56 serves as a rotation angle controller that controls the rotation angle of the heat shield 27. When the heat shield 27 is at the home position shown in FIG. 14A, an upstream edge 54*a* of the feeler 54 in the rotation direction R3 of the fixing belt 21, that is, a leading edge of the feeler 54 in the backward, second pivot direction X2 of the feeler 54, enters the gap between the light emitter and the light receiver of the home position sensor 55. Thus, the upstream edge 54*a* of the feeler 54 shields the light receiver of the home position sensor 55 from light emitted from the light emitter of the home position sensor 55. The angle sensor 56 is positioned relative to the home position sensor 55 such that a phase angle formed by the angle sensor 56 with the home position sensor 55 in the second pivot direction X2 of the feeler 54 is greater than a central angle A54 of the feeler 54.

When the heat shield 27 is at the home position shown in FIG. 14A, the heat shield 27 does not shield the fixing belt 21 from the halogen heater pair 23 and allows the halogen heater pair 23 to heat the fixing belt 21 in the increased direct heating span $\alpha$ as shown in FIG. 3. Further, when the heat shield 27 is at the home position shown in FIG. 14A, the heat shield 27 is at an upstream end of the movable span thereof in the rotation direction R3 of the fixing belt 21. Hence, during a print job, the heat shield 27 does not move beyond the home position shown in FIG. 14A in the backward second pivot direction X2.

With the configuration of the position detector 53 described above, as the signal output by the home position sensor 55 switches from low to high, the controller 90 determines that the heat shield 27 is at the home position. Simultaneously, the angle sensor 56 outputs a low signal. If the heat shield 27 halts at a position other than the home position as the image forming apparatus 1 interrupts its operation when a fault occurs or the fixing device 20 is detached from the image forming apparatus 1, while the image forming apparatus 1 is turned on after the fault is eliminated, the heat shield 27 pivots backward in the second pivot direction X2 to the home position so that the controller 90 determines that the heat shield 27 returns to the home position. Accordingly, it is not necessary to pivot the heat shield 27 forward in the first pivot direction X1, shortening the time taken for the heat shield 27 to return to the home position. Consequently, the image forming apparatus 1 is warmed up to the predetermined temperature quickly as the image forming apparatus 1 is turned on.

Conversely, as the heat shield 27 pivots from the home position shown in FIG. 14A in the forward first pivot direction X1 of the feeler 54, that is, the rotation direction R3 of the fixing belt 21, a downstream edge 54*b* of the feeler 54 in the rotation direction R3 of the fixing belt 21 overlaps the angle sensor 56 as shown in FIG. 14B, shielding the light receiver of the angle sensor 56 from light emitted from the light emitter of the angle sensor 56. Accordingly, the signal output by the angle sensor 56 switches from low to high. The position of the heat shield 27 shown in FIG. 14B defines the reference position, that is, a zero point. As the motor 42 depicted in FIG. 7 rotates forward for a predetermined number of pulses, the heat shield 27 pivots from the reference position shown in FIG. 14B to the target shield position shown in FIG. 14C. The reference position of the heat shield 27 is downstream from the home position thereof in the forward first pivot direction X1, that is, the rotation direction R3 of the fixing belt 21. Additionally, the home position of the heat shield 27 is set to a position where, as the heat shield 27 moves between the home position and the reference position in the forward first pivot direction X1 and the backward second pivot direction X2, the position detector 53 detects that the heat shield 27 reaches the reference position and the home position.

In order to change the area of the direct heating span α of the fixing belt 21, a terminal of the heat shield 27 movable in the circumferential direction of the fixing belt 21 is determined based on the distance or the rotation angle from the reference position of the heat shield 27 by open loop control. Accordingly, open loop control simplifies the structure of the position detector 53 compared to closed loop control in which the controller 90 drives and rotates the motor 42 based on feedback of the position of the heat shield 27 and halts the heat shield 27 after the controller 90 determines that the heat shield 27 reaches the shield position.

As the heat shield 27 pivots in the forward first pivot direction X1 farther, the area of the fixing belt 21 shielded by the heat shield 27 from the halogen heater pair 23 increases in the direct heating span α. That is, as the heat shield 27 pivots in the forward first pivot direction X1 farther, the area of the direct heating span α of the fixing belt 21 decreases. While the heat shield 27 moves between the home position shown in FIG. 14A and the reference position shown in FIG. 14B, the area of the fixing belt 21 shielded by the heat shield 27 from the halogen heater pair 23 in the direct heating span α is substantially zero. As the heat shield 27 moves from the reference position shown in FIG. 14B in the forward first pivot direction X1, the area of the direct heating span α of the fixing belt 21 decreases. As the heat shield 27 rotating in the forward first pivot direction X1 halts at various shield positions, the area of the direct heating span α of the fixing belt 21 decreases stepwise.

Figure 15:
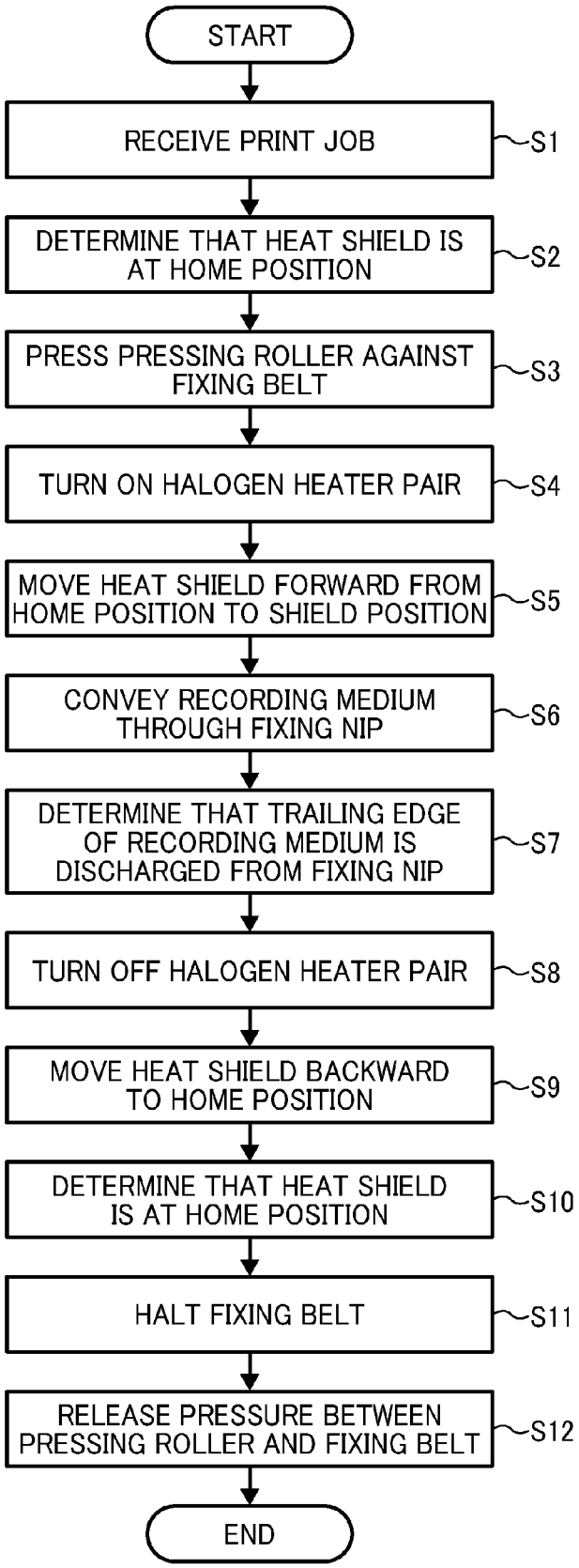
FIG. 15 is a flowchart showing processes of an operation of the fixing device shown in FIG. 14A.

With reference to FIG. 15, a description is provided of an operation of the fixing device 20 before and during a print job.

FIG. 15 is a flowchart showing processes of the operation of the fixing device 20. As the controller 90 installable in the image forming apparatus 1 or the fixing device 20 receives a signal to start a print job in step S1, the controller 90 determines that the heat shield 27 is at the home position shown in FIG. 14A in step S2. For example, as described above, when the home position sensor 55 outputs a high signal as the feeler 54 shields the light receiver of the home position sensor 55 from light emitted from the light emitter of the home position sensor 55 and the angle sensor 56 outputs a low signal as the angle sensor 56 allows light emitted from the light emitter of the angle sensor 56 to reach the light receiver of the angle sensor 56, the controller 90 determines that the heat shield 27 is at the home position. On the other hand, the pressurization assembly described below having released pressure exerted by the pressing roller 22 to the fixing belt 21 presses the pressing roller 22 against the fixing belt 21 in step S3. Thereafter, the controller 90 turns on the halogen heater pair 23 in step S4, causing the halogen heater pair 23 to start heating the fixing belt 21.

After the halogen heater pair 23 is turned on, the heat shield 27 pivots from the home position shown in FIG. 14A in the forward first pivot direction X1. As the angle sensor 56 detects the feeler 54 at the reference position shown in FIG. 14B, the controller 90 drives the motor 42 of the heat shield driver 46 depicted in FIG. 7 for the number of pulses corresponding to the distance from the reference position to the target shield position, moving the heat shield 27 to the target shield position shown in FIG. 14C in step S5. Thereafter, as shown in FIG. 2, a recording medium P bearing an unfixed toner image T is conveyed to the fixing nip N in the recording medium conveyance direction A1 such that the unfixed toner image T faces the fixing belt 21. In step S6, as the fixing belt 21 rotating in the rotation direction R3 and the pressing roller 22 rotating in the rotation direction R4 convey the recording medium P bearing the toner image T through the fixing nip N, the fixing belt 21 and the pressing roller 22 apply heat and pressure to the recording medium P, fixing the toner image T on the recording medium P. Thus, the print job is finished.

The recording medium P bearing the fixed toner image T is discharged from the fixing nip N in a recording medium conveyance direction A2. As a leading edge of the recording medium P comes into contact with a front edge of a separator, the separator separates the recording medium P from the fixing belt 21. Thereafter, the separated recording medium P is discharged by the output roller pair 13 depicted in FIG. 1 onto the outside of the image forming apparatus 1, that is, the output tray 14 where the recording medium P is stocked.

With reference to FIG. 15, a description is provided of an operation of the fixing device 20 after the print job is finished.

As the controller 90 determines that a trailing edge of the last recording medium P of at least one recording medium P for the print job is discharged from the fixing nip N in step S7, the heat shield 27 pivots backward in the second pivot direction X2 to the home position shown in FIG. 14D in step S9. Concurrently with or prior to start of backward pivot of the heat shield 27 in the second pivot direction X2 in step S9, the controller 90 turns off the halogen heater pair 23 in step S8. As the controller 90 determines that the heat shield 27 reaches the home position based on a signal output by the home position sensor 55 in step S10, the controller 90 halts the fixing belt 21 in step S11. In step S12, the controller 90 causes the pressurization assembly to release pressure between the pressing roller 22 and the fixing belt 21.

It may be difficult to directly detect the trailing edge of the last recording medium P discharged from the fixing nip N. To address this circumstance, the controller 90 may determine that the trailing edge of the last recording medium P is discharged from the fixing nip N when the controller 90 determines that a predetermined time elapses after the controller 90 receives an external signal. The external signal defines a signal transmitted between the controller 90 and the components other than the fixing device 20 that are incorporated in the image forming apparatus 1. For example, the external signal is a writing signal (e.g., F-gate signal) that controls writing of an electrostatic latent image on the photoconductor 5 depicted in FIG. 1 with a laser beam emitted by the exposure device 9 or a registration signal that controls the registration roller pair 12. A time taken from receipt of those signals corresponding to the last recording medium P until the trailing edge of the last recording medium P is discharged from the fixing nip N is constant for each linear velocity and therefore defined as a delay time. After the delay time, the heat shield 27 starts rotating backward in the second pivot direction X2. Thus, the heat shield 27 starts rotating backward when the tailing edge of the last recording medium P is discharged from the fixing nip N.

According to this exemplary embodiment, as the print job starts, the heat shield 27 pivots from the home position forward in the first pivot direction X1 to the shield position. Conversely, as the print job is finished safely, the heat shield 27 returns to the home position. That is, the heat shield 27 is at the home position as the next print job starts. Accordingly, even if the halogen heater pair 23 is turned on as the next print job starts, the controller 90 controls the temperature of the outer circumferential surface of the fixing belt 21 precisely, suppressing variation in temperature of the fixing belt 21 and resultant warping and deformation of the fixing belt 21. For example, if a thin endless belt having a decreased thermal capacity is used as the fixing belt 21, the surface temperature of the fixing belt 21 increases quickly immediately after the halogen heater pair 23 is turned on. Accordingly, the surface temperature of the fixing belt 21 may vary substantially, rendering the fixing belt 21 susceptible to warping and deformation. To address this circumstance, the heat shield 27 is controlled as described above.

For example, if the heat shield 27 is situated at the shield position when the next print job starts, even if the halogen heater pair 23 is turned on after the next print job starts, both lateral ends of the fixing belt 21 in the axial direction thereof that are shielded from the halogen heater pair 23 by the heat shield 27 are not heated to a predetermined temperature although the center of the fixing belt 21 in the axial direction thereof is heated to the predetermined temperature, resulting in variation in temperature of the fixing belt 21 in the axial direction thereof. To address this circumstance, if the heat shield 27 moves to the home position when the previous print job is finished, even if the halogen heater pair 23 is turned on after the next print job starts, the fixing belt 21 is heated evenly throughout the direct heating span $\alpha$ thereof before the heat shield 27 moves to the shield position. Accordingly, the temperature of the fixing belt 21 does not vary in the axial direction thereof, preventing warping and deformation of the fixing belt 21 and resultant faulty fixing.

According to this exemplary embodiment, the halogen heater pair 23 is turned off before the heat shield 27 moves backward in the second pivot direction X2 when the print job is finished. Alternatively, the halogen heater pair 23 is turned off concurrently with start of movement of the heat shield 27. Thus, the halogen heater pair 23 does not heat the fixing belt 21 unnecessarily. Additionally, even if a non-conveyance span on the fixing belt 21, that is, both lateral ends of the fixing belt 21 in the axial direction thereof, where the recording medium P is not conveyed over the fixing belt 21 has an increased temperature, both lateral ends of the fixing belt 21 in the axial direction thereof do not overheat, preventing surface warping and deformation of the fixing belt 21.

Even if the non-conveyance span on the fixing belt 21 overheats when the halogen heater pair 23 is turned off, the fixing belt 21 halts after the halogen heater pair 23 is turned off. Accordingly, the fixing belt 21 dissipates heat as it rotates, preventing warping and deformation of the fixing belt 21. The controller 90 determines a time at which the fixing belt 21 halts based on the temperature of the fixing belt 21 detected by the temperature sensor 28. For example, the controller 90 halts the fixing belt 21 when the controller 90 determines that the temperature of the fixing belt 21 detected by the temperature sensor 28 is below a predetermined temperature.

As described above, the fixing device 20 incorporates the pressurization assembly that presses the pressing roller 22 against the fixing belt 21 and releases pressure between the pressing roller 22 and the fixing belt 21.

Figure 16A:
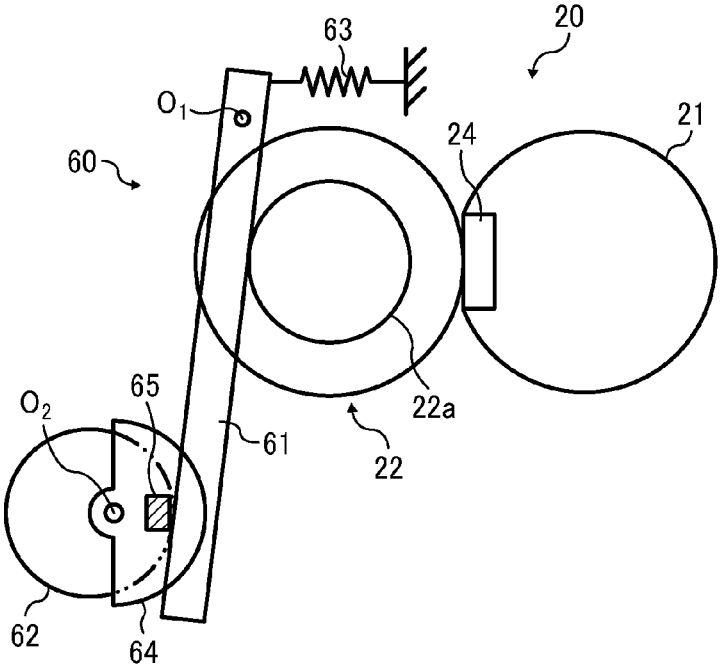
FIG. 16A is a vertical sectional view of the fixing device shown in FIG. 2 illustrating a pressurization assembly releasing pressure between a pressing roller and a fixing belt.
Figure 16B:
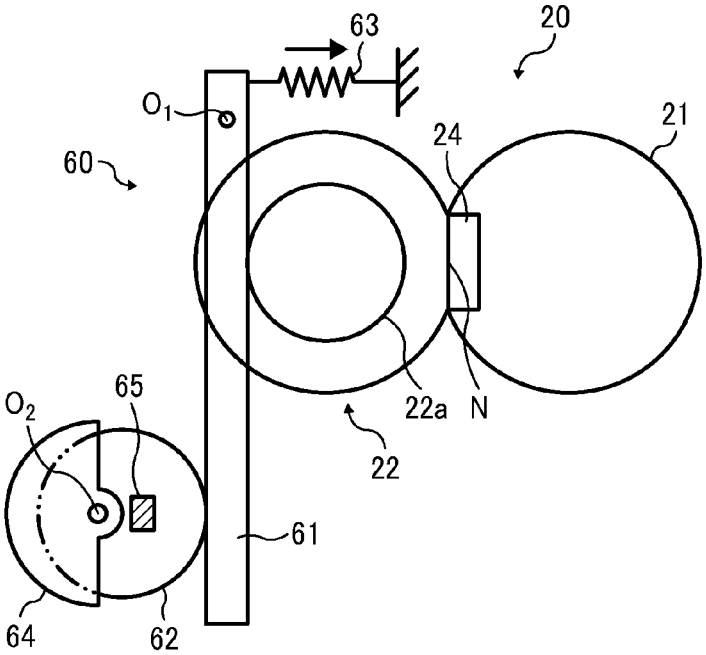
FIG. 16B is a vertical sectional view of the fixing device shown in FIG. 2 illustrating the pressurization assembly pressing the pressing roller against the fixing belt.

With reference to FIGS. 16A and 16B, a description is provided of a construction of a pressurization assembly 60 that presses the pressing roller 22 against the fixing belt 21 and releases pressure between the pressing roller 22 and the fixing belt 21.

FIG. 16A is a vertical sectional view of the fixing device 20 illustrating the pressurization assembly 60 that releases pressure between the pressing roller 22 and the fixing belt 21. FIG. 16B is a vertical sectional view of the fixing device 20 illustrating the pressurization assembly 60 that presses the pressing roller 22 against the fixing belt 21. It is to be noted that the pressurization assembly 60 is also applicable to the fixing device 20S incorporating the heat shield 27S shown in FIGS. 10 and 11. As shown in FIG. 16B, the pressurization assembly 60 presses the pressing roller 22 against the fixing belt 21 to form the fixing nip N between the pressing roller 22 and the fixing belt 21. Conversely, as shown in FIG. 16A, the pressurization assembly 60 releases pressure between the pressing roller 22 and the fixing belt 21. For example, the pressurization assembly 60 separates the pressing roller 22 from the fixing belt 21 or brings the pressing roller 22 into contact with the fixing belt 21 with no pressure therebetween.

The pressurization assembly 60 includes a mechanism for detecting whether or not the pressing roller 22 presses against the fixing belt 21 at the fixing nip N. For example, the pressurization assembly 60 includes a lever 61, a cam 62, a biasing member 63 (e.g., a tension spring), a feeler 64 serving as a detected member, and a sensor 65 (e.g., a photo interrupter) serving as a detector. The lever 61 is pivotably mounted on a shaft O1 at one end of the lever 61 in a longitudinal direction thereof. Another end of the lever 61 in the longitudinal direction thereof contacts an outer circumferential surface of the cam 62. An intermediate portion of the lever 61 in the longitudinal direction thereof contacts the metal core 22*a* of the pressing roller 22 that projects outboard from the elastic layer 22*b* and the release layer 22*c* depicted in FIG. 2 at a lateral end of the pressing roller 22 in the axial direction thereof. The cam 62 is pivotably supported by an eccentric shaft O2 and is driven and rotated by a driver (e.g., a motor). The lever 61 is pressed against the outer circumferential surface of the cam 62 by resilience from the biasing member 63.

The pressing roller 22 is supported by the side plates of the fixing device 20 such that the pressing roller 22 is slidable horizontally in FIGS. 16A and 16B to press against the fixing belt 21 and separate from the fixing belt 21. As shown in FIG. 16A, as the outer circumferential surface of a semicircle having a decreased diameter of the cam 62 contacts the lever 61, the resilience generated by the biasing member 63 biases the lever 61 in a direction to separate from the metal core 22*a* of the pressing roller 22. Accordingly, the pressing roller 22 moves in a direction to separate from the fixing belt 21, thus exerting no pressure to the fixing belt 21. Conversely, as shown in FIG. 16B, as the outer circumferential surface of another semicircle having an increased diameter of the cam 62 contacts the lever 61, the cam 62 presses the lever 61 against the metal core 22*a* of the pressing roller 22, thus pressing the pressing roller 22 against the fixing belt 21 at the fixing nip N.

The feeler 64 is substantially formed in a semicircle pivotable about the shaft O2 in accordance with rotation of the cam 62. As shown in FIG. 16A, as pressure between the pressing roller 22 and the fixing belt 21 is released, the feeler 64 overlaps the sensor 65 to shield the sensor 65 from light. Accordingly, as the sensor 65 outputs the high signal, the controller 90 determines that the pressing roller 22 contacts the fixing belt 21 with no pressure therebetween or is isolated from the fixing belt 21. Conversely, as the sensor 65 outputs the low signal, the controller 90 determines that the pressing roller 22 presses against the fixing belt 21.

During the print job, the pressurization assembly 60 presses the pressing roller 22 against the fixing belt 21 as shown in FIG. 16B. Conversely, as the print job is finished, after the fixing belt 21 halts, the cam 62 rotates to a pressure release position shown in FIG. 16A, bringing the pressing roller 22 into contact with the fixing belt 21 with no pressure therebetween or isolating the pressing roller 22 from the fixing belt 21. If the pressurization assembly 60 brings the pressing roller 22 into contact with the fixing belt 21 with no pressure therebetween or isolates the pressing roller 22 from the fixing belt 21 before the fixing belt 21 halts, the fixing belt 21 may slip and overheat locally, resulting in deformation of the fixing belt 21. To address this circumstance, the pressurization assembly 60 brings the pressing roller 22 into contact with the fixing belt 21 with no pressure therebetween or isolates the pressing roller 22 from the fixing belt 21 after the fixing belt 21 halts as described above.

The present invention is not limited to the details of the exemplary embodiments described above, and various modifications and improvements are possible. For example, instead of the fixing belt 21, a hollow tubular roller or a solid roller may be used as a fixing rotary body. The shape of the heat shields 27 and 27S is not limited to those shown in FIGS. 8 and 10. For example, although the shield portion 48 of the heat shield 27 has a single step as shown in FIG. 8 and the shield portion 48S of the heat shield 27S has two steps as shown in FIG. 10, a heat shield having three or more steps may be used according to the size of the recording medium P.

A description is provided of advantages of the fixing devices 20 and 20S.

As shown in FIGS. 2, 14A, and 14B, the fixing devices 20 and 20S include a fixing rotary body (e.g., the fixing belt 21) rotatable in the rotation direction R3; a heater (e.g., the halogen heater pair 23) to heat the fixing rotary body; an opposed body (e.g., the pressing roller 22) contacting an outer circumferential surface of the fixing rotary body to form the fixing nip N therebetween through which a recording medium P is conveyed; a heat shield (e.g., the heat shields 27 and 27S) interposed between the heater and the fixing rotary body and movable in a circumferential direction of the fixing rotary body between a home position where the heat shield is disposed opposite the heater indirectly and a shield position where the heat shield is disposed opposite the heater directly to shield the fixing rotary body from the heater; and a controller (e.g., the controller 90) operatively connected to the heat shield to move the heat shield to the home position when a print job is finished.

Since the heat shield moves to the home position when a print job is finished, the heat shield is at the home position when the next print job starts, facilitating the controller to control the surface temperature of the fixing rotary body after the heater starts heating the fixing rotary body. Accordingly, temperature variation of the fixing rotary body is reduced, suppressing warping and deformation of the fixing rotary body and improving fixing performance of the fixing devices 20 and 20S.

As shown in FIGS. 8 and 10, the shield portions 48 and 48S are disposed at both lateral ends of the heat shields 27 and 27S in the longitudinal direction thereof, respectively. Alternatively, the shield portions 48 and 48S may be disposed at one lateral end of the heat shields 27 and 27S in the longitudinal direction thereof, respectively. In this case, the recording medium P is conveyed over the fixing belt 21 along one lateral edge of the fixing belt 21 in the axial direction thereof and the shield portions 48 and 48S are disposed in proximity to another lateral edge of the fixing belt 21 in the axial direction thereof.

According to the exemplary embodiments described above, the pressing roller 22 serves as an opposed body. Alternatively, a pressing belt or the like may be used as an opposed body.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a heater disposed opposite and heating the fixing rotary body and configured to output radiated heat, the heater comprising:

a first heater having a first heat generator; and a second heater having a second heat generator disposed outboard from the first heat generator in an axial direction of the fixing rotary body;

an opposed body to contact the fixing rotary body with releasable pressure therebetween to form a fixing nip therebetween through which a recording medium is conveyed;

a heat shield interposed between the heater and the fixing rotary body and movable in a circumferential direction of the fixing rotary body between a home position where the heat shield is disposed opposite the heater indirectly and a shield position where the heat shield is disposed opposite the heater directly to shield the fixing rotary body from the radiated heat of the heater; and a controller operatively connected to the heat shield to move the heat shield to the home position when a print job is finished.

2. The fixing device according to claim 1, wherein the controller moves the heat shield from the home position to the shield position when the print job starts.

3. The fixing device according to claim 1, wherein the heat shield situated at the home position creates an increased direct heating span on the fixing rotary body where the heater is disposed opposite the fixing rotary body directly.

4. The fixing device according to claim 1, wherein the controller moves the heat shield to the home position when a predetermined delay time elapses after the controller receives an external signal.

5. The fixing device according to claim 4, wherein the external signal includes a writing signal that controls writing of an electrostatic latent image with a laser beam emitted by an exposure device, the electrostatic latent image to be formed into a toner image on a last recording medium of the print job.

6. The fixing device according to claim 4, wherein the external signal includes a registration signal that controls registration of a last recording medium of the print job to be sent to a transferor that transfers a toner image onto the last recording medium.

7. The fixing device according to claim 4, wherein the delay time terminates when a trailing edge of a last recording medium is discharged from the fixing nip.

8. The fixing device according to claim 1, wherein the controller turns off the heater before the heat shield moves to the home position when the print job is finished.

9. The fixing device according to claim 1, wherein the controller turns off the heater concurrently with movement of the heat shield to the home position when the print job is finished.

10. The fixing device according to claim 1, wherein the controller halts the fixing rotary body after the heat shield moves to the home position when the print job is finished.

11. The fixing device according to claim 10, further comprising a temperature detector disposed opposite the fixing rotary body to detect a temperature of the fixing rotary body, wherein the controller halts the fixing rotary body based on the temperature of the fixing rotary body detected by the temperature detector.

12. The fixing device according to claim 10, further comprising a pressurization assembly to press the opposed body against the fixing rotary body and release pressure between the opposed body and the fixing rotary body, wherein the pressurization assembly releases the pressure between the opposed body and the fixing rotary body after the fixing rotary body halts.

13. The fixing device according to claim 1, further comprising a position detector linked with the heat shield to detect a position of the heat shield.

14. The fixing device according to claim 13, wherein the position detector includes:

a feeler connected to the heat shield and pivotable in the circumferential direction of the fixing rotary body in accordance with movement of the heat shield;

a home position sensor defining the home position where the heat shield is disposed opposite the heater indirectly to detect the feeler as the feeler overlaps the home position sensor; and an angle sensor disposed downstream from the home position sensor in the direction of rotation of the fixing rotary body to detect the feeler as the feeler overlaps the angle sensor, the angle sensor defining a reference position of the heat shield.

15. The fixing device according to claim 14, wherein the controller moves the heat shield forward in the direction of rotation of the fixing rotary body from the reference position to the shield position where the heat shield is disposed opposite the heater directly.

16. The fixing device according to claim 1, wherein the fixing rotary body includes an endless belt, the opposed body includes a pressing roller, and the heat shield includes a metal plate.

17. An image forming apparatus comprising the fixing device according to claim 1.

18. A fixing method comprising:

receiving a print job;

determining that a heat shield is at a home position where the heat shield is disposed opposite a heater indirectly;

pressing an opposed body against a fixing rotary body;

turning on the heater to heat the fixing rotary body;

moving the heat shield forward from the home position to a shield position where the heat shield is disposed opposite the heater directly;

rotating the fixing rotary body to convey a recording medium through a fixing nip formed between the fixing rotary body and the opposed body;

determining that a trailing edge of the recording medium is discharged from the fixing nip;

turning off the heater;

moving the heat shield backward from the shield position to the home position;

determining that the heat shield is at the home position;

halting the fixing rotary body; and releasing pressure between the opposed body and the fixing rotary body.

19. The fixing method according to claim 18, wherein the fixing rotary body is halted when a temperature of the fixing rotary body is below a predetermined temperature.

20. A fixing device of an image forming apparatus, the fixing device comprising:

a fixing rotary body rotatable in a predetermined direction of rotation;

a heater disposed opposite and heating the fixing rotary body and configured to output radiated heat;

an opposed body to contact the fixing rotary body with releasable pressure therebetween to form a fixing nip therebetween through which a recording medium is conveyed;

a heat shield interposed between the heater and the fixing rotary body and movable in a circumferential direction of the fixing rotary body between a home position where the heat shield is disposed opposite the heater indirectly and a shield position where the heat shield is disposed opposite the heater directly to shield the fixing rotary body from the radiated heat of the heater; and a controller operatively connected to the heat shield to move the heat shield to the home position when a print job is finished, and to move the heat shield to the home position when the image forming apparatus is powered on.

* * * * *